US007810255B2

(12) United States Patent
Schindler et al.

(10) Patent No.: US 7,810,255 B2
(45) Date of Patent: Oct. 12, 2010

(54) INTERLOCKING FLUID-FILLED CHAMBERS FOR AN ARTICLE OF FOOTWEAR

(75) Inventors: Eric S. Schindler, Portland, OR (US); John F. Swigart, Portland, OR (US)

(73) Assignee: Nike, Inc., Beaverton, OR (US)

( * ) Notice: Subject to any disclaimer, the term of this patent is extended or adjusted under 35 U.S.C. 154(b) by 892 days.

(21) Appl. No.: 11/671,970

(22) Filed: Feb. 6, 2007

(65) Prior Publication Data

US 2008/0184595 A1 Aug. 7, 2008

(51) Int. Cl.
*A43B 13/20* (2006.01)

(52) U.S. Cl. ..... 36/29; 36/35 B

(58) Field of Classification Search ..... 36/29, 36/35 B, 153, 93, 88, 28
See application file for complete search history.

(56) References Cited

U.S. PATENT DOCUMENTS

| | | | |
|---|---|---|---|
| 900,867 | A | 10/1908 | Miller |
| 1,069,001 | A | 7/1913 | Guy |
| 1,181,441 | A | 5/1916 | Franklin |
| 1,240,153 | A | 9/1917 | Olsen |
| 1,304,915 | A | 5/1919 | Spinney |
| 1,323,610 | A | 12/1919 | Price |
| 1,514,468 | A | 11/1924 | Schopf |
| 1,584,034 | A | 5/1926 | Klotz |
| 1,625,582 | A | 4/1927 | Anderson |
| 1,625,810 | A | 4/1927 | Krichbaum |
| 1,869,257 | A | 7/1932 | Hitzler |
| 1,916,483 | A | 7/1933 | Krichbaum |
| 1,970,803 | A | 8/1934 | Johnson |
| 2,004,906 | A | 6/1935 | Simister |
| 2,080,469 | A | 5/1937 | Gilbert |
| 2,086,389 | A | 7/1937 | Pearson |
| 2,269,342 | A | 1/1942 | Johnson |
| 2,365,807 | A | 12/1944 | Dialynas |

(Continued)

FOREIGN PATENT DOCUMENTS

| | | |
|---|---|---|
| AT | 181938 | 2/1906 |

(Continued)

OTHER PUBLICATIONS

Sports Research Review, NIKE, Inc., Jan./Feb. 1990.

(Continued)

*Primary Examiner*—Ted Kavanaugh
(74) *Attorney, Agent, or Firm*—Plumsea Law Group, LLC

(57) ABSTRACT

An article of footwear having an upper and a sole structure secured to the upper. The sole structure includes a first chamber and a second chamber that each enclose a fluid. The first chamber and the second chamber both define a plurality of projections and depressions. At least a portion of the projections of the first chamber are located within the depressions of the second chamber, and at least a portion of the projections of the second chamber are located within the depressions of the first chamber. In some configurations, each of the first chamber and the second chamber may form portions of upper and lower surfaces of a pneumatic component. In addition, colors of the first chamber and the second chamber may be selected such that the colors combine at an interface of the first chamber and the second chamber.

24 Claims, 21 Drawing Sheets

U.S. PATENT DOCUMENTS

| | | | | | |
|---|---|---|---|---|---|
| 2,488,382 | A | | 11/1949 | Davis | |
| 2,546,827 | A | | 3/1951 | Lavinthal | |
| 2,600,239 | A | | 6/1952 | Gilbert | |
| 2,645,865 | A | | 7/1953 | Town | |
| 2,677,906 | A | | 5/1954 | Reed | |
| 2,703,770 | A | | 3/1955 | Melzer | |
| 2,748,401 | A | | 6/1956 | Winstead | |
| 2,762,134 | A | | 9/1956 | Town | |
| 3,030,640 | A | | 4/1962 | Gosman | |
| 3,048,514 | A | | 8/1962 | Bentele et al. | |
| 3,120,712 | A | | 2/1964 | Menken | |
| 3,121,430 | A | | 2/1964 | O'Reilly | |
| 3,204,678 | A | | 9/1965 | Worcester | |
| 3,251,076 | A | | 5/1966 | Burke | |
| 3,284,264 | A | | 11/1966 | O'Rourke | |
| 3,335,045 | A | | 8/1967 | Post | |
| 3,366,525 | A | | 1/1968 | Jackson | |
| 3,469,576 | A | | 9/1969 | Smith et al. | |
| 3,568,227 | A | | 3/1971 | Dunham | |
| 3,589,037 | A | | 6/1971 | Gallagher | |
| 3,608,215 | A | | 9/1971 | Fukuoka | |
| 3,685,176 | A | | 8/1972 | Rudy | |
| 3,758,964 | A | | 9/1973 | Nishimura | |
| 3,765,422 | A | | 10/1973 | Smith | |
| 4,017,931 | A | | 4/1977 | Golden | |
| 4,054,960 | A | | 10/1977 | Pettit et al. | |
| 4,115,934 | A | | 9/1978 | Hall | |
| 4,123,855 | A | | 11/1978 | Thedford | |
| 4,129,951 | A | | 12/1978 | Petrosky | |
| 4,167,795 | A | | 9/1979 | Lambert, Jr. | |
| 4,183,156 | A | | 1/1980 | Rudy | |
| 4,187,620 | A | | 2/1980 | Seiner | |
| 4,217,705 | A | | 8/1980 | Donzis | |
| 4,219,945 | A | | 9/1980 | Rudy | |
| 4,271,606 | A | | 6/1981 | Rudy | |
| 4,287,250 | A | | 9/1981 | Rudy | |
| 4,292,702 | A | | 10/1981 | Phillips | |
| 4,297,797 | A | | 11/1981 | Meyers | |
| 4,305,212 | A | | 12/1981 | Coomer | |
| 4,328,599 | A | | 5/1982 | Mollura | |
| 4,358,902 | A | | 11/1982 | Cole et al. | |
| 4,431,003 | A | | 2/1984 | Sztancsik | |
| 4,446,634 | A | | 5/1984 | Johnson et al. | |
| 4,458,430 | A | | 7/1984 | Peterson | |
| 4,483,030 | A | | 11/1984 | Plick et al. | |
| 4,486,964 | A | | 12/1984 | Rudy | |
| 4,506,460 | A | | 3/1985 | Rudy | |
| 4,547,919 | A | | 10/1985 | Wang | |
| 4,662,087 | A | | 5/1987 | Beuch | |
| 4,670,995 | A | | 6/1987 | Huang | |
| 4,686,130 | A | | 8/1987 | Kon | |
| 4,698,864 | A | | 10/1987 | Graebe | |
| 4,722,131 | A | | 2/1988 | Huang | |
| 4,744,157 | A | | 5/1988 | Dubner | |
| 4,779,359 | A | | 10/1988 | Famolare, Jr. | |
| 4,782,602 | A | | 11/1988 | Lakic | |
| 4,803,029 | A | | 2/1989 | Iversen et al. | |
| 4,817,304 | A | | 4/1989 | Parker et al. | |
| 4,823,482 | A | | 4/1989 | Lakic | |
| 4,845,338 | A | | 7/1989 | Lakic | |
| 4,845,861 | A | | 7/1989 | Moumgdgian | |
| 4,874,640 | A | | 10/1989 | Donzis | |
| 4,891,855 | A | | 1/1990 | Cheng-Chung | |
| 4,906,502 | A | | 3/1990 | Rudy | |
| 4,912,861 | A | | 4/1990 | Huang | |
| 4,936,029 | A | | 6/1990 | Rudy | |
| 4,965,899 | A | | 10/1990 | Sekido et al. | |
| 4,970,807 | A | * | 11/1990 | Anderie et al. | 36/28 |
| 4,972,611 | A | | 11/1990 | Swartz et al. | |
| 4,991,317 | A | | 2/1991 | Lakic | |
| 4,999,931 | A | | 3/1991 | Vermeulen | |
| 4,999,932 | A | | 3/1991 | Grim | |
| 5,014,449 | A | | 5/1991 | Richard et al. | |
| 5,022,109 | A | | 6/1991 | Pekar | |
| 5,025,575 | A | | 6/1991 | Lakic | |
| 5,042,176 | A | | 8/1991 | Rudy | |
| 5,044,030 | A | | 9/1991 | Balaton | |
| 5,046,267 | A | | 9/1991 | Kilgore et al. | |
| 5,083,361 | A | | 1/1992 | Rudy | |
| 5,092,060 | A | * | 3/1992 | Frachey et al. | 36/29 |
| 5,104,477 | A | | 4/1992 | Williams et al. | |
| 5,131,174 | A | | 7/1992 | Drew et al. | |
| 5,155,927 | A | | 10/1992 | Bates et al. | |
| 5,158,767 | A | | 10/1992 | Cohen et al. | |
| 5,179,792 | A | | 1/1993 | Brantingham | |
| 5,193,246 | A | | 3/1993 | Huang | |
| 5,199,191 | A | | 4/1993 | Moumdjian | |
| 5,224,277 | A | | 7/1993 | Sang Do | |
| 5,224,278 | A | | 7/1993 | Jeon | |
| 5,228,156 | A | | 7/1993 | Wang | |
| 5,235,715 | A | | 8/1993 | Donzis | |
| 5,238,231 | A | | 8/1993 | Huang | |
| 5,245,766 | A | | 9/1993 | Warren | |
| 5,253,435 | A | | 10/1993 | Auger et al. | |
| 5,257,470 | A | | 11/1993 | Auger et al. | |
| 5,297,349 | A | | 3/1994 | Kilgore | |
| 5,335,382 | A | | 8/1994 | Huang | |
| 5,337,492 | A | | 8/1994 | Anderie et al. | |
| 5,353,459 | A | | 10/1994 | Potter et al. | |
| 5,353,523 | A | | 10/1994 | Kilgore et al. | |
| 5,355,552 | A | | 10/1994 | Huang | |
| 5,367,791 | A | | 11/1994 | Gross et al. | |
| 5,406,719 | A | | 4/1995 | Potter | |
| 5,425,184 | A | | 6/1995 | Lyden et al. | |
| 5,493,792 | A | | 2/1996 | Bates et al. | |
| 5,543,194 | A | | 8/1996 | Rudy | |
| 5,545,463 | A | | 8/1996 | Schmidt et al. | |
| 5,558,395 | A | | 9/1996 | Huang | |
| 5,572,804 | A | | 11/1996 | Skaja et al. | |
| 5,595,004 | A | | 1/1997 | Lyden et al. | |
| 5,625,964 | A | | 5/1997 | Lyden et al. | |
| 5,669,161 | A | | 9/1997 | Huang | |
| 5,686,167 | A | | 11/1997 | Rudy | |
| 5,704,137 | A | | 1/1998 | Dean et al. | |
| 5,713,141 | A | | 2/1998 | Mitchell et al. | |
| 5,741,568 | A | | 4/1998 | Rudy | |
| 5,753,061 | A | | 5/1998 | Rudy | |
| 5,755,001 | A | | 5/1998 | Potter et al. | |
| 5,771,606 | A | | 6/1998 | Litchfield et al. | |
| 5,802,739 | A | | 9/1998 | Potter et al. | |
| 5,830,553 | A | | 11/1998 | Huang | |
| 5,832,630 | A | | 11/1998 | Potter | |
| 5,846,063 | A | | 12/1998 | Lakic | |
| 5,902,660 | A | | 5/1999 | Huang | |
| 5,907,911 | A | | 6/1999 | Huang | |
| 5,916,664 | A | | 6/1999 | Rudy | |
| 5,925,306 | A | | 7/1999 | Huang | |
| 5,937,462 | A | | 8/1999 | Huang | |
| 5,952,065 | A | | 9/1999 | Mitchell et al. | |
| 5,976,451 | A | | 11/1999 | Skaja et al. | |
| 5,979,078 | A | | 11/1999 | McLaughlin | |
| 5,987,780 | A | | 11/1999 | Lyden et al. | |
| 5,993,585 | A | | 11/1999 | Goodwin et al. | |
| 6,009,637 | A | | 1/2000 | Pavone | |
| 6,013,340 | A | | 1/2000 | Bonk et al. | |
| 6,027,683 | A | | 2/2000 | Huang | |
| 6,029,962 | A | | 2/2000 | Shorten et al. | |
| 6,055,746 | A | | 5/2000 | Lyden et al. | |
| 6,065,150 | A | | 5/2000 | Huang | |
| 6,098,313 | A | | 8/2000 | Skaja | |
| 6,119,371 | A | | 9/2000 | Goodwin et al. | |
| 6,127,010 | A | | 10/2000 | Rudy | |
| 6,128,837 | A | | 10/2000 | Huang | |
| 6,192,606 | B1 | | 2/2001 | Pavone | |

| | | | | |
|---|---|---|---|---|
| 6,253,466 | B1 | 7/2001 | Harmon-Weiss | |
| 6,374,514 | B1 | 4/2002 | Swigart | |
| 6,457,262 | B1 | 10/2002 | Swigart | |
| 6,550,085 | B2 | 4/2003 | Roux | |
| 6,665,958 | B2 | 12/2003 | Goodwin | |
| 6,783,184 | B2 | 8/2004 | DiBattista et al. | |
| 6,796,056 | B2 | 9/2004 | Swigart | |
| 6,837,951 | B2 | 1/2005 | Rapaport | |
| 6,889,451 | B2 | 5/2005 | Passke et al. | |
| 6,918,198 | B2 | 7/2005 | Chi | |
| 6,931,764 | B2 | 8/2005 | Swigart et al. | |
| 6,971,193 | B1 | 12/2005 | Potter et al. | |
| 7,000,335 | B2 | 2/2006 | Swigart et al. | |
| 7,020,988 | B1 | 4/2006 | Holden | |
| 7,051,456 | B2 | 5/2006 | Swigart et al. | |
| 7,070,845 | B2 | 7/2006 | Thomas et al. | |
| 7,073,276 | B2 | 7/2006 | Swigart | |
| 7,076,891 | B2 | 7/2006 | Goodwin | |
| 7,086,179 | B2 | 8/2006 | Dojan et al. | |
| 7,131,218 | B2 | 11/2006 | Schindler | |
| 2006/0230636 | A1* | 10/2006 | Kokstis et al. | 36/35 B |
| 2006/0277794 | A1 | 12/2006 | Schindler | |

FOREIGN PATENT DOCUMENTS

| | | | |
|---|---|---|---|
| AT | 200963 | | 12/1958 |
| CA | 727582 | | 2/1966 |
| DE | 32 34 086 | | 9/1982 |
| DE | G92 01 758.4 | | 12/1992 |
| EP | 0 094 868 | | 5/1983 |
| EP | 0 215 974 | A | 9/1985 |
| EP | 0 605 485 | B1 | 9/1992 |
| FR | 1195549 | | 11/1959 |
| FR | 1406610 | | 11/1965 |
| FR | 2144464 | | 1/1973 |
| FR | 2404413 | | 4/1979 |
| FR | 2407008 | | 5/1979 |
| FR | 2483321 | | 4/1981 |
| FR | 2614510 | | 4/1987 |
| FR | 2.639537 | | 11/1988 |
| GB | 7441 | | 0/1906 |
| GB | 14955 | | 0/1893 |
| GB | 233387 | | 1/1924 |
| GB | 978654 | | 12/1964 |
| GB | 1128764 | | 10/1968 |
| JP | 266718 | | 9/1992 |
| JP | 6-181802 | | 7/1994 |
| TW | 75100322 | | 1/1975 |
| TW | 54221 | | 6/1978 |
| WO | WO89/10074 | | 11/1989 |
| WO | WO90/10396 | | 9/1990 |
| WO | WO91/11928 | | 8/1991 |
| WO | WO91/11931 | | 8/1991 |
| WO | WO92/08384 | | 5/1992 |
| WO | WO95/20332 | | 8/1995 |
| WO | 0078171 | A | 12/2000 |
| WO | WO01/19211 | | 3/2001 |
| WO | 0170060 | A | 9/2001 |

OTHER PUBLICATIONS

Brooks Running Catalog, Fall 1991.

International Search Report and Written Opinion in PCT/US2007/088586, mailed Aug. 27, 2008.

* cited by examiner

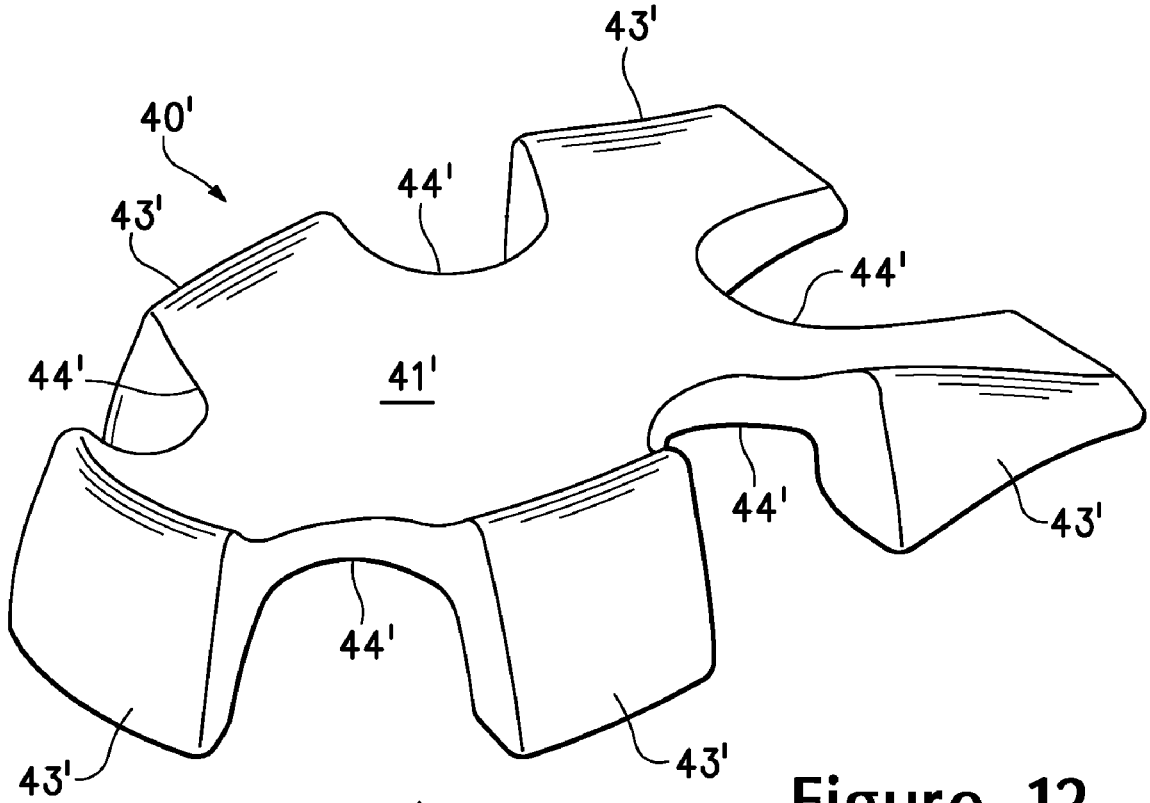
Figure 12
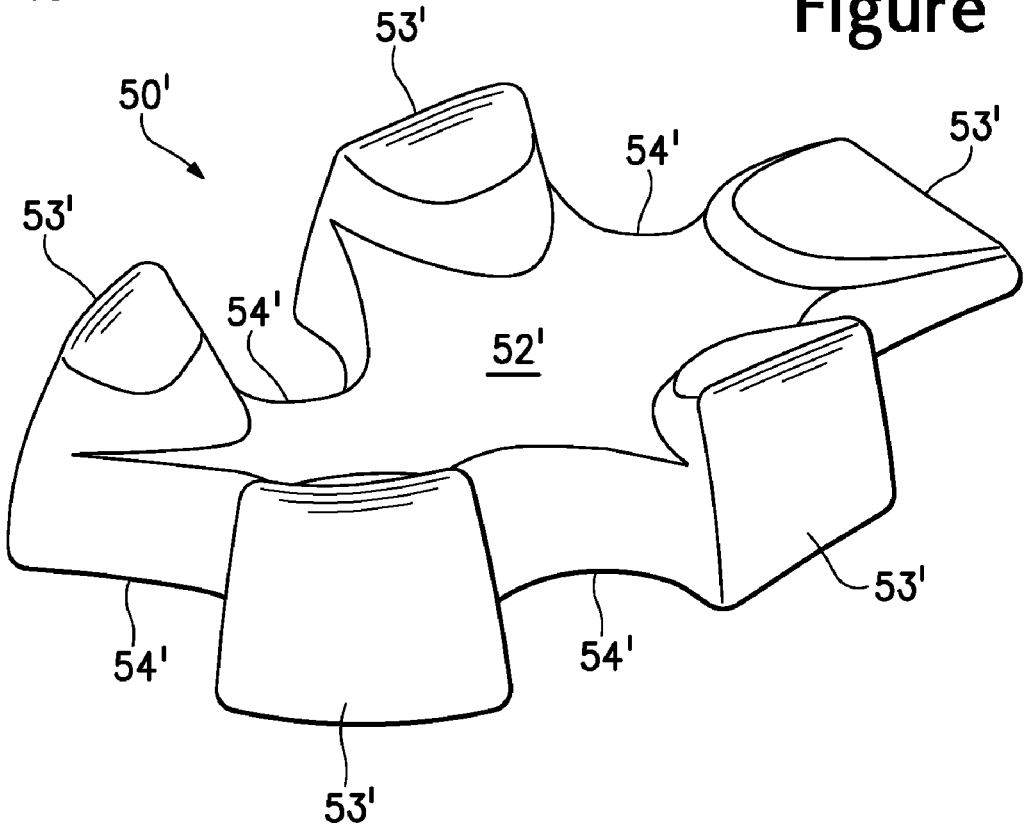

INTERLOCKING FLUID-FILLED CHAMBERS FOR AN ARTICLE OF FOOTWEAR

BACKGROUND

A conventional article of athletic footwear includes two primary elements, an upper and a sole structure. The upper may be formed from a plurality of material elements (e.g., textiles, leather, and foam materials) defining a void that securely receives and positions the foot with respect to the sole structure. The sole structure is secured to a lower surface of the upper and is generally positioned to extend between the foot and the ground. In addition to attenuating ground reaction forces, the sole structure may provide traction and control various foot motions, such as pronation. Accordingly, the upper and the sole structure operate cooperatively to provide a comfortable structure that is suited for a wide variety of ambulatory activities, such as walking and running.

The sole structure of an article of athletic footwear generally exhibits a layered configuration that includes a comfort-enhancing insole, a resilient midsole formed from a polymer foam, and a ground-contacting outsole that provides both abrasion-resistance and traction. Suitable polymer foam materials for the midsole include ethylvinylacetate or polyurethane that compress resiliently under an applied load to attenuate ground reaction forces. Conventional polymer foam materials compress resiliently, in part, due to the inclusion of a plurality of open or closed cells that define an inner volume substantially displaced by gas. Following repeated compressions, the cell structure of the polymer foam may deteriorate, thereby resulting in an decreased compressibility and decreased force attenuation characteristics of the sole structure.

One manner of reducing the mass of a polymer foam midsole and decreasing the effects of deterioration following repeated compressions is disclosed in U.S. Pat. No. 4,183,156 to Rudy, in which cushioning is provided by a fluid-filled chamber formed of an elastomeric material. The chamber includes a plurality of subchambers that are in fluid communication and jointly extend along a length and across a width of the footwear. The chamber may be encapsulated in a polymer foam material, as disclosed in U.S. Pat. No. 4,219,945 to Rudy. The combination of the chamber and the encapsulating polymer foam material functions as a midsole. Accordingly, the upper is attached to the upper surface of the polymer foam material and an outsole is affixed to the lower surface.

Fluid-filled chambers suitable for footwear applications may be manufactured by a two-film technique, in which two separate sheets of elastomeric film are formed to exhibit the overall peripheral shape of the chamber. The sheets are then bonded together along their respective peripheries to form a sealed structure, and the sheets are also bonded together at predetermined interior areas to give the chamber a desired configuration. That is, interior bonds (i.e., bonds spaced inward from the periphery) provide the chamber with a predetermined shape and size upon pressurization. In order to pressurize the chamber, a nozzle or needle connected to a fluid pressure source is inserted into a fill inlet formed in the chamber. Following pressurization of the chamber, the fill inlet is sealed and the nozzle is removed. A similar procedure, referred to as thermoforming, may also be utilized, in which a heated mold forms or otherwise shapes the sheets of elastomeric film during the manufacturing process.

Chambers may also be manufactured by a blow-molding technique, wherein a molten or otherwise softened elastomeric material in the shape of a tube is placed in a mold having the desired overall shape and configuration of the chamber. The mold has an opening at one location through which pressurized air is provided. The pressurized air induces the liquefied elastomeric material to conform to the shape of the inner surfaces of the mold. The elastomeric material then cools, thereby forming a chamber with the desired shape and configuration. As with the two-film technique, a nozzle or needle connected to a fluid pressure source is inserted into a fill inlet formed in the chamber in order to pressurize the chamber. Following pressurization of the chamber, the fill inlet is sealed and the nozzle is removed.

SUMMARY

One aspect of the invention relates to an article of footwear having an upper and a sole structure secured to the upper. The sole structure includes a first chamber and a second chamber that each enclose a fluid. The first chamber has a first surface with a first contoured configuration, and the second chamber has a second surface with a second contoured configuration. The first surface is in contact with the second surface, and the first contoured configuration is shaped to mate or join with the second contoured configuration.

Another aspect of the invention relates to an article of footwear having an upper and a sole structure secured to the upper. The sole structure includes a first chamber and a second chamber that each enclose a fluid. The first chamber defines a plurality of first projections and a plurality of first depressions located between the first projections. Similarly, the second chamber defines a plurality of second projections and a plurality of second depressions located between the second projections. At least a portion of the first projections are located within the second depressions, and at least a portion of the second projections are located within the first depressions.

Yet another aspect of the invention is an article of footwear having an upper and a sole structure secured to the upper. The sole structure includes a pneumatic component with an upper surface and an opposite lower surface. The pneumatic component includes an upper chamber that forms a first portion of an upper surface of the pneumatic component, and the upper chamber forms a first portion of a lower surface of the pneumatic component. The pneumatic component also includes a lower chamber located below the upper chamber. The lower chamber forms a second portion of the upper surface of the pneumatic component, and the lower chamber forms a second portion of the lower surface of the pneumatic component.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

FIG. 12 is an exploded perspective view of the second pneumatic component.

DETAILED DESCRIPTION

The following discussion and accompanying figures disclose various embodiments of interlocking fluid-filled chambers in a sole structure for an article of footwear. Concepts related to the chambers and the sole structure are disclosed with reference to footwear having a configuration that is suitable for running. The sole structure is not limited solely to footwear designed for running, however, and may be utilized with a wide range of athletic footwear styles, including basketball shoes, tennis shoes, football shoes, cross-training shoes, walking shoes, soccer shoes, and hiking boots, for example. The sole structure may also be utilized with footwear styles that are generally considered to be non-athletic, including dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Figure 1:
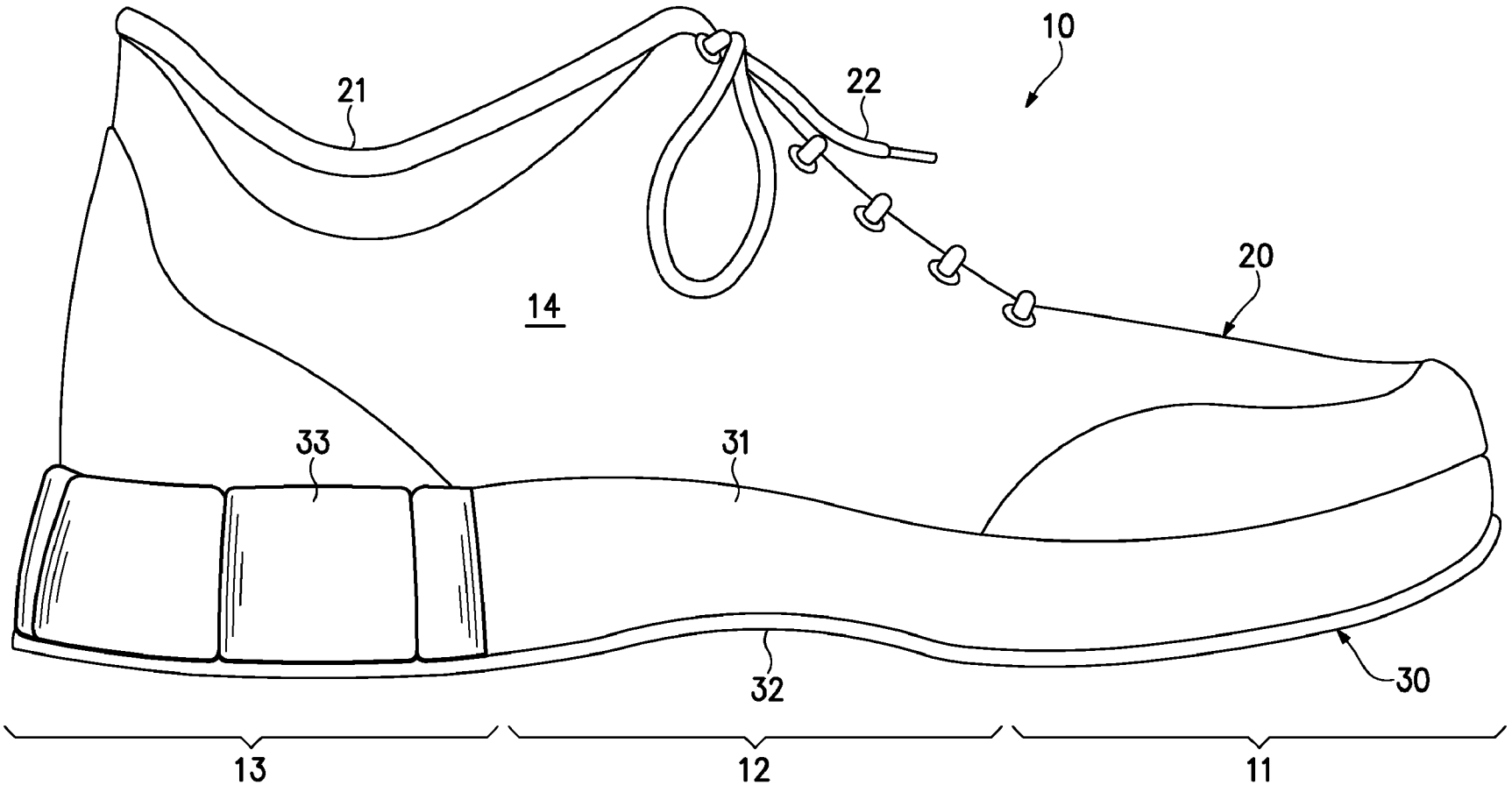
FIG. 1 is a lateral side elevational view of an article of footwear incorporating a first pneumatic component.
Figure 2:
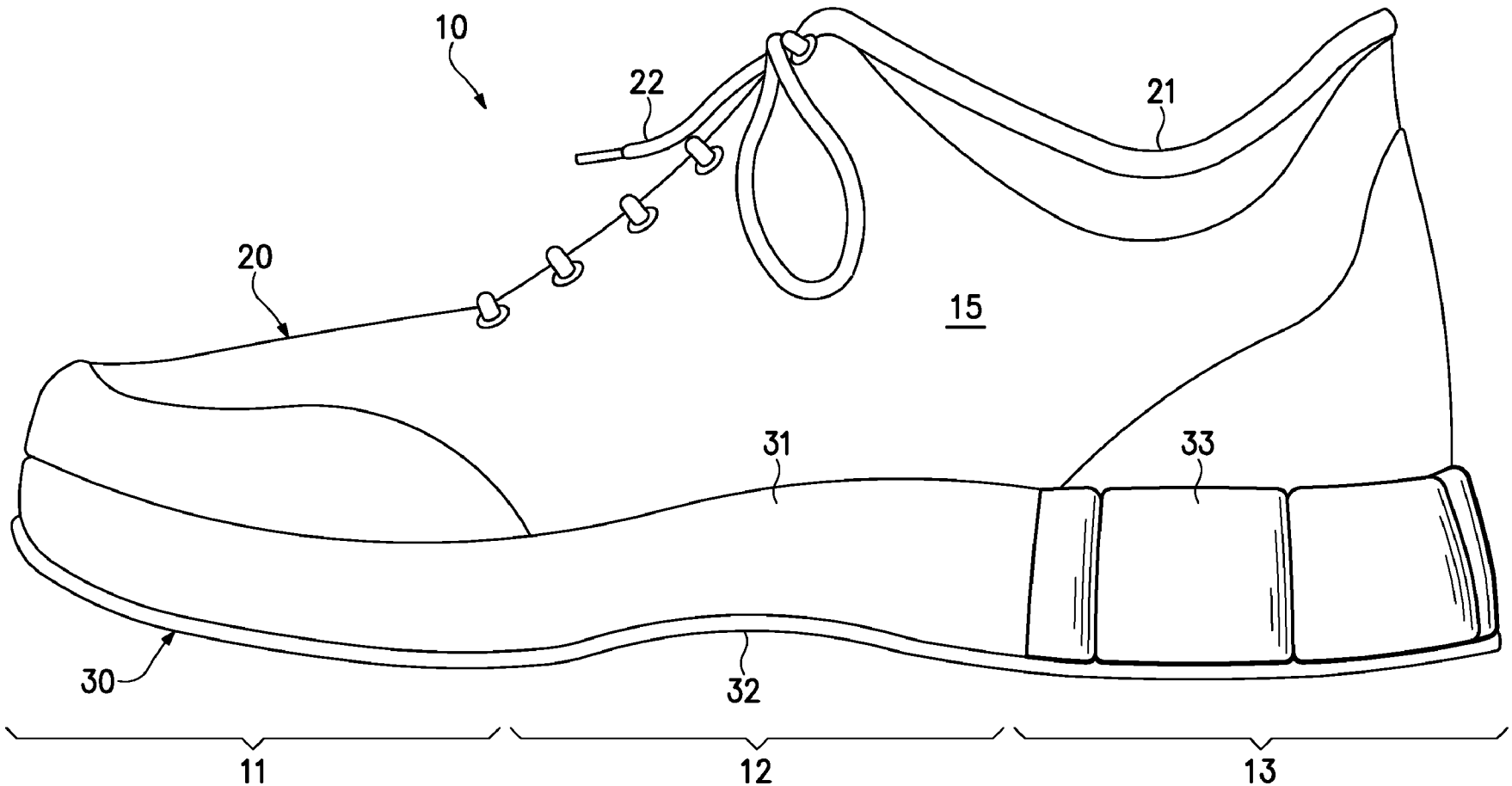
FIG. 2 is a medial side elevational view of the article of footwear incorporating the first pneumatic component.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In forefoot region 11 and midfoot region 12, sole structure 30 includes a midsole element 31 and an outsole 32. Midsole element 31 may be formed from a polymer foam material, such as polyurethane or ethylvinylacetate, that attenuates ground reaction forces when sole structure 30 is compressed between the foot and the ground. In addition to the polymer foam material, midsole element 31 may incorporate a fluid-filled chamber to further enhance the ground reaction force attenuation characteristics of sole structure 30. Outsole 32, which may be absent in some configurations of footwear 10, is secured to a lower surface of midsole element 31 and may extend onto side areas of midsole element 31. Outsole 32 may be formed from a rubber material that provides a durable and wear-resistant surface for engaging the ground. In addition, outsole 32 may be textured to enhance the traction (i.e., friction) properties between footwear 10 and the ground.

In addition to midsole element 31 and outsole 32, sole structure 30 includes a pneumatic component 33 located within heel region 13. Although sole structure 30 may incorporate other elements (e.g., polymer foam elements, plates, moderators, reinforcing structures) in heel region 13, pneumatic component 33 is depicted as extending between upper 20 and outsole 32. Accordingly, an upper surface of pneumatic component 33 may be secured to upper 20, and a lower surface of pneumatic component 33 may be secured to outsole 32.

First Component Configuration

Figure 3:
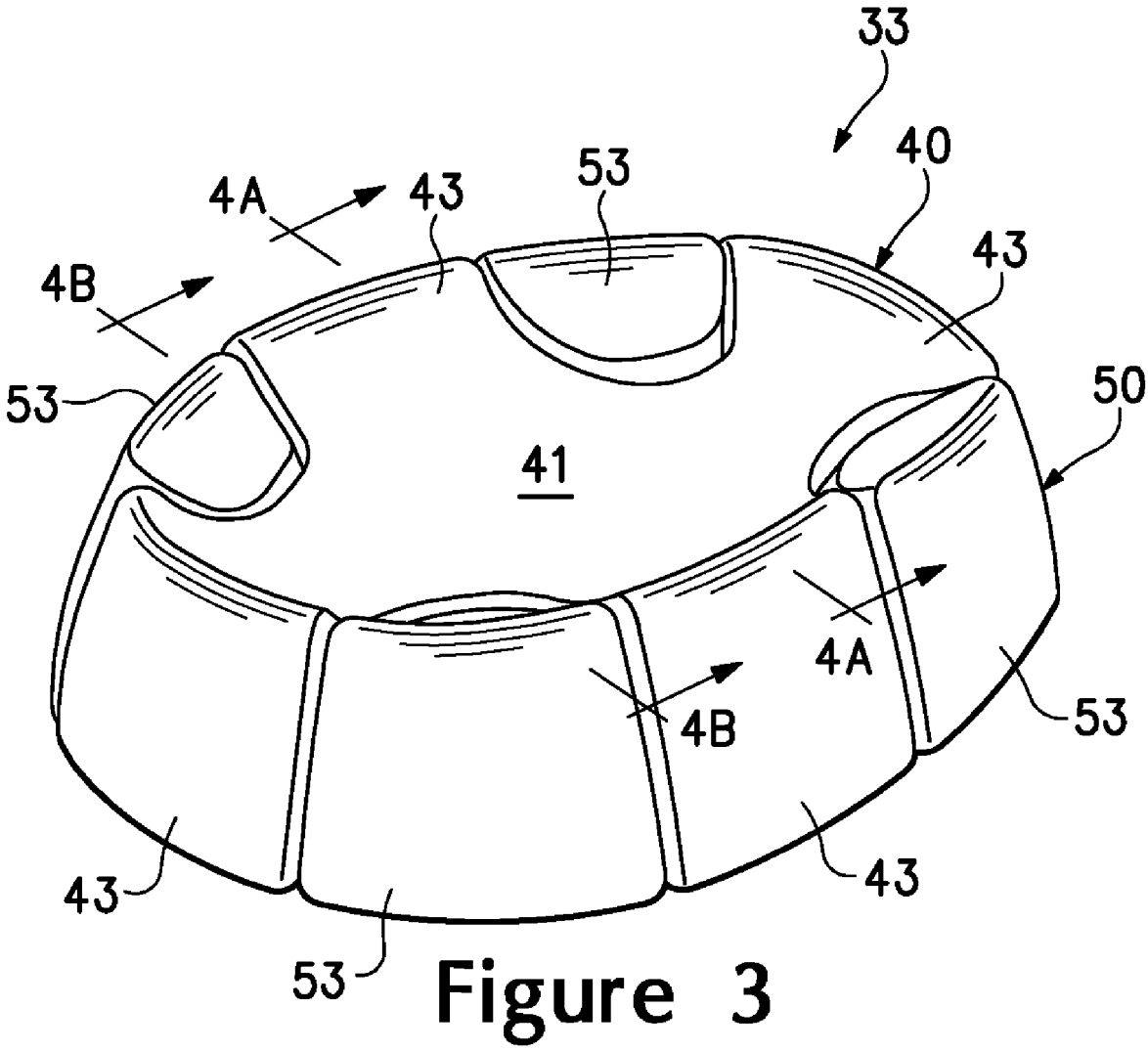
FIG. 3 is a perspective view of the first pneumatic component.
Figure 4A:
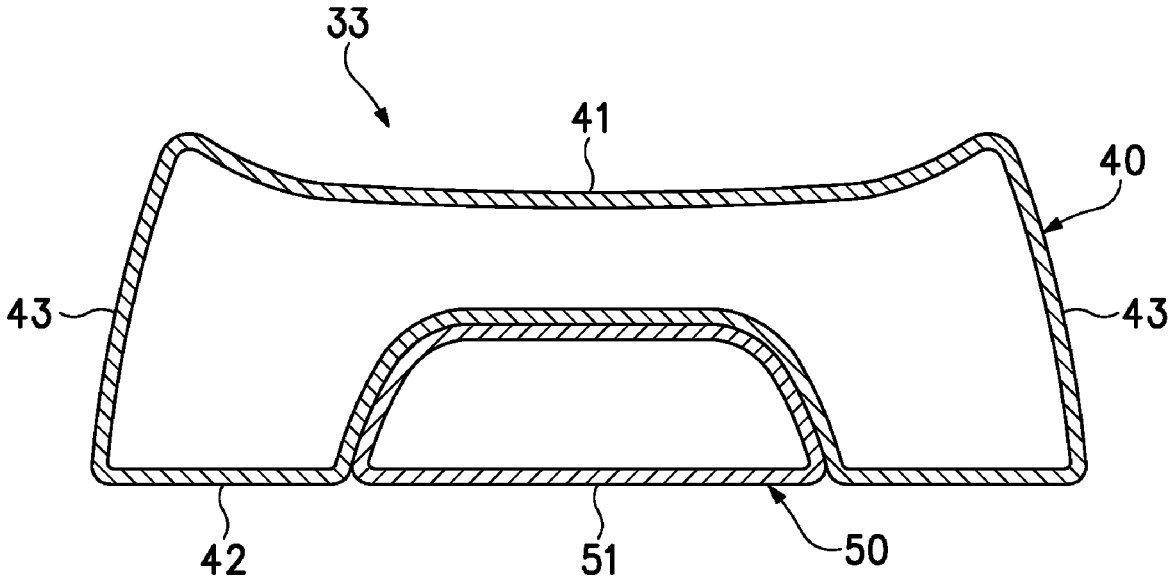
FIGS. 4A and 4B are a cross-sectional views of the first pneumatic component, as defined by section lines 4A and 4B in FIG. 3.
Figure 4B:
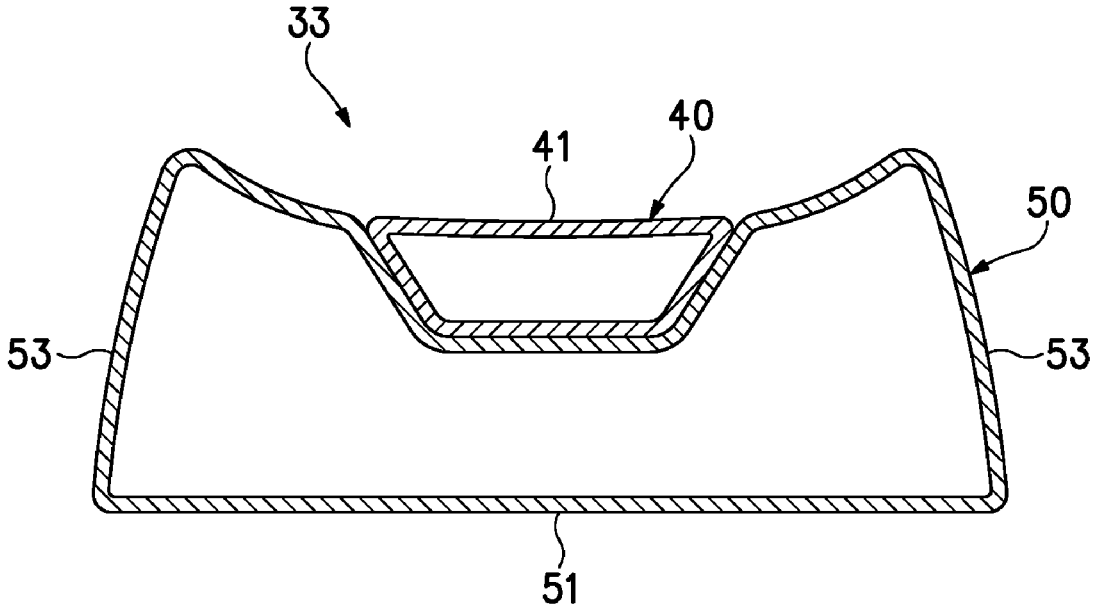
Figure 5:
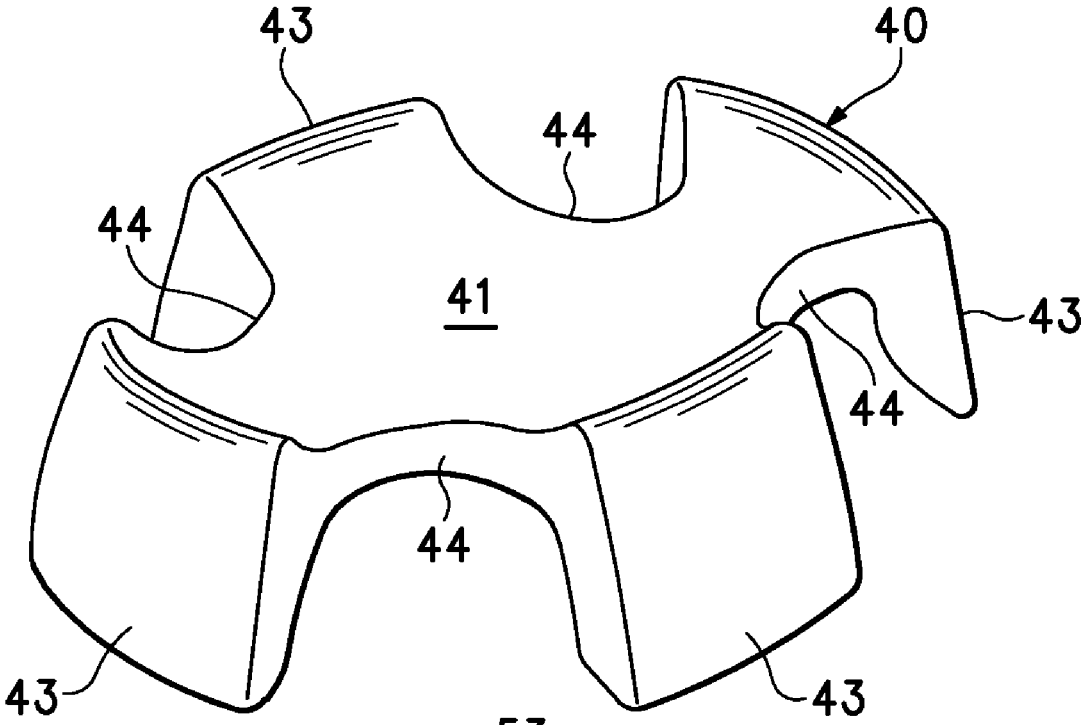
FIG. 5 is an exploded perspective view of the first pneumatic component.
Figure 5:
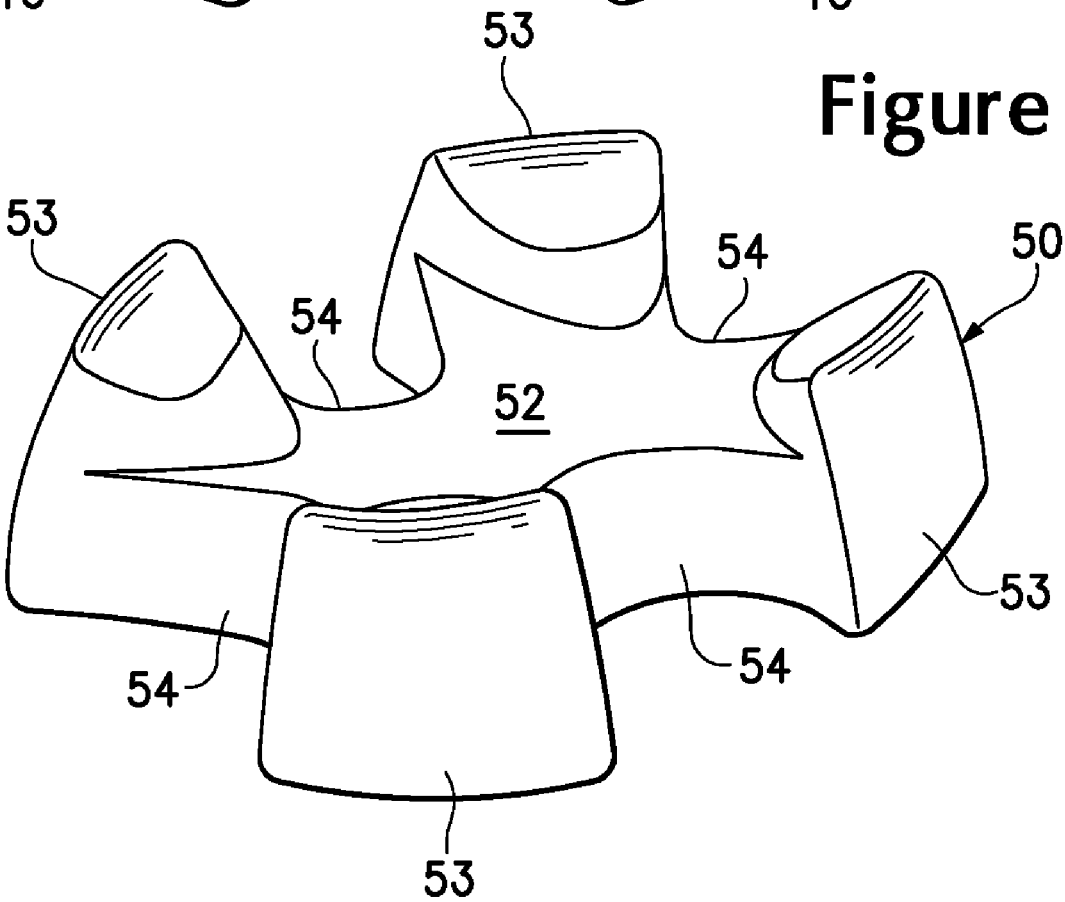

The primary elements of pneumatic component 33, which is depicted separate from footwear 10 in FIGS. 3-5, are a first chamber 40 and a second chamber 50. Each of chambers 40 and 50 are formed from an exterior barrier that encloses a fluid. More particularly, chambers 40 and 50 are formed from a polymer material that is sealed to enclose a gas. As described in greater detail below, portions of chambers 40 and 50 have corresponding configurations that interlock or otherwise mate to join chambers 40 and 50 to each other. Although the corresponding configurations of chambers 40 and 50 may be sufficient to join chambers 40 and 50 to each other when incorporated into footwear 10, various adhesives, thermo-bonding processes, or other joining techniques may be utilized to further secure chamber 40 to chamber 50. Alternately, the polymer foam material of midsole element 31 may encapsulate portions of chambers 40 and 50 to effectively secure chamber 40 to chamber 50.

Figure 6:
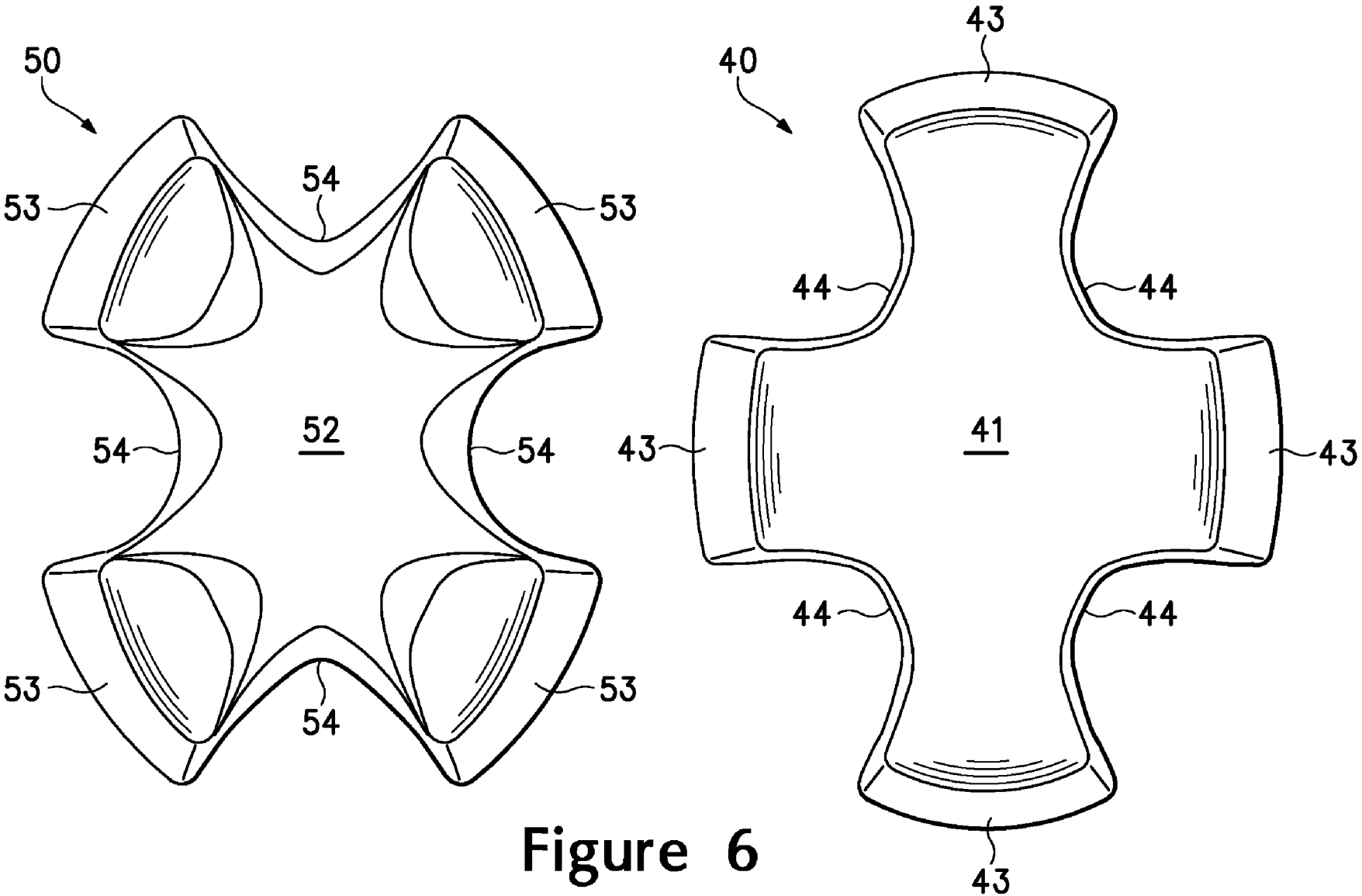
FIG. 6 depicts top plan views of a first chamber and a second chamber of the first pneumatic component.
Figure 7:
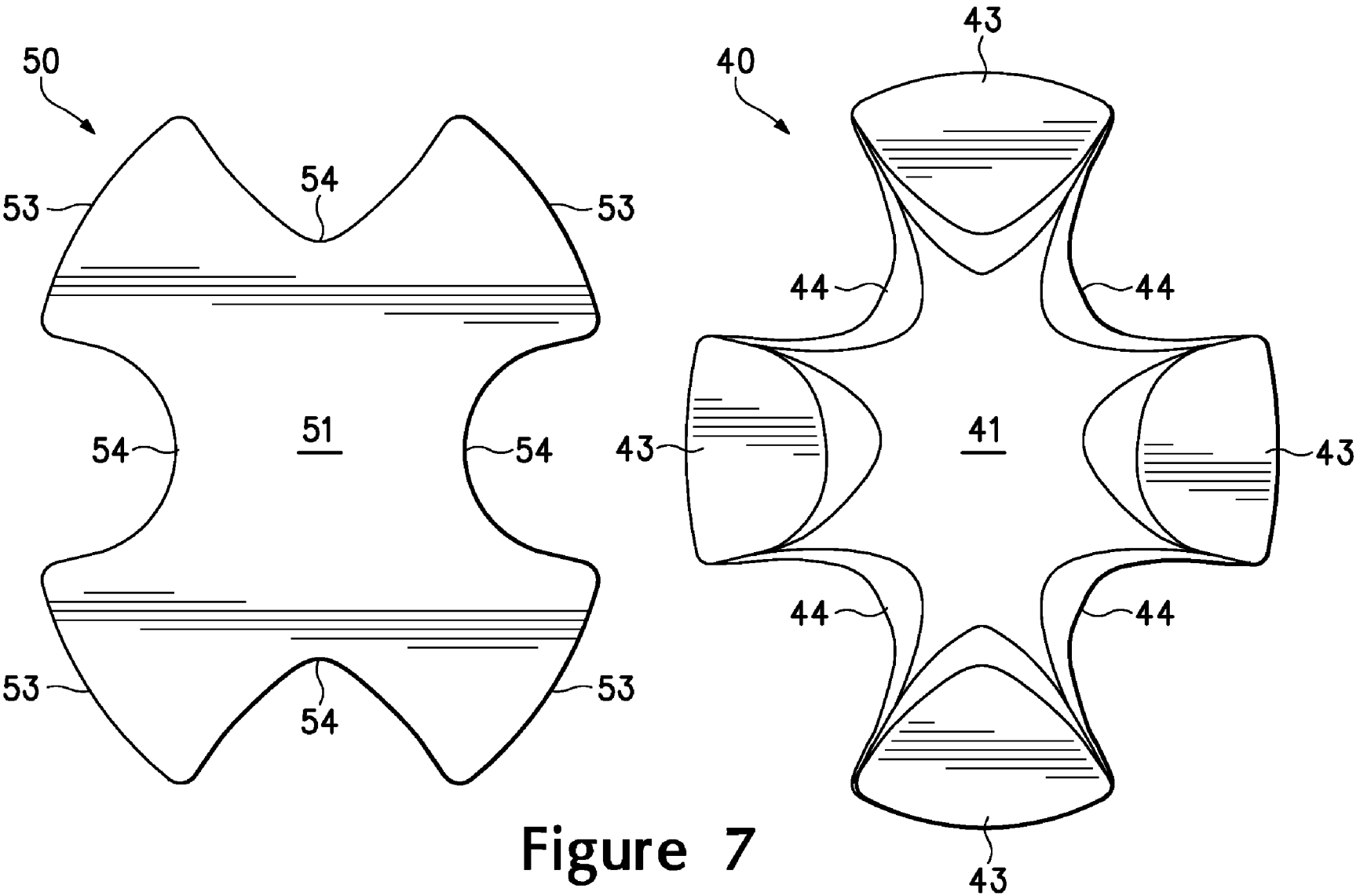
FIG. 7 depicts bottom plan views of the first chamber and the second chamber of the first pneumatic component.
Figure 8:
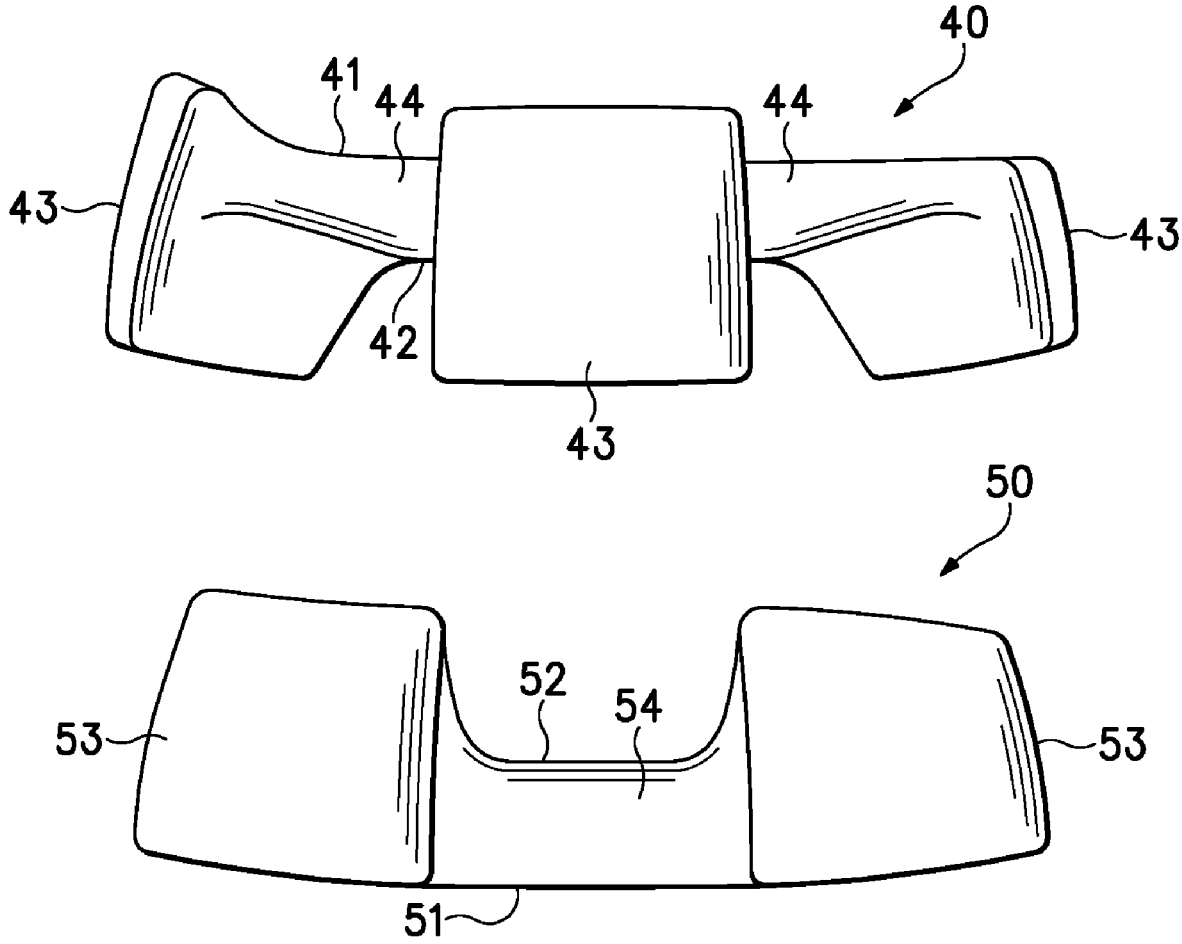
FIG. 8 depicts side elevational views of the first chamber and the second chamber of the first pneumatic component.

First chamber 40 is depicted in FIGS. 6-8 and has an upper surface 41 and an opposite lower surface 42. Whereas upper surface 41 exhibits a generally concave configuration with a relatively planar central area, lower surface 42 is contoured to define four projections 43 and four depressions 44 located between projections 43. Relative to the plane defined by the central area of upper surface 41, projections 43 extend (a) radially-outward from the central area of first chamber 40 and in a direction that is parallel to the plane defined by upper surface 41 and (b) downward and away from the plane defined by the central area of upper surface 41. That is, projections 43 extend both radially-outward and downward to impart a three-dimensional structure to first chamber 40. In effect, therefore, projections 43 form lobes that extend from the central area, and depressions 44 are spaces located between the lobes.

Second chamber 50 is also depicted in FIGS. 6-8 and has a lower surface 51 and an opposite upper surface 52. Whereas lower surface 51 exhibits a generally planar configuration, upper surface 52 is contoured to define four projections 53 and four depressions 54 located between projections 53. Relative to the plane defined by lower surface 51, projections 53 extend (a) radially-outward from a central area of second chamber 50 and in a direction that is parallel to the plane defined by lower surface 51 and (b) upward and away from the plane defined by lower surface 51. That is, projections 53 extend both radially-outward and upward to impart a three-dimensional structure to second chamber 50. In effect, therefore, projections 53 form lobes that extend from the central area, and depressions 54 are spaces located between the lobes.

Each of chambers 40 and 50 are depicted in FIGS. 6-8 as having x-shaped configurations, but are oriented differently within footwear 10. Whereas projections 43 of first chamber 40 extend downward, projections 53 of second chamber 50 extend upward. In this configuration, and as generally depicted in FIGS. 3 and 5, projections 43 respectively extend into depressions 54, and projections 53 respectively extend into depressions 44. Lower surface 42 and upper surface 52 form, therefore, oppositely-contoured surfaces that interlock or otherwise mate to join chambers 40 and 50 to each other.

Chambers 40 and 50 may be pressurized between zero and three-hundred-fifty kilopascals (i.e., approximately fifty-one pounds per square inch) or more. As discussed in the Background of the Invention section above, interior bonds (i.e., bonds spaced inward from a periphery of a chamber) provide a chamber with a predetermined shape and size upon pressurization with a fluid. That is, the interior bonds prevent a chamber from ballooning or otherwise expanding outward during pressurization. In contrast with some conventional fluid-filled chambers, however, chambers 40 and 50 are depicted as having a configuration that does not include interior bonds. In order to limit the degree to which chambers 40 and 50 expand outward due to the action of the fluid within chambers 40 and 50, therefore, a suitable fluid pressure for chambers 40 and 50 is between zero and thirty-five kilopascals (i.e., approximately five pounds per square inch). In other configurations, however, interior bonds may be utilized to accommodate greater fluid pressures, the material selected for chambers 40 and 50 may be modified (i.e., in thickness or type) to accommodate greater fluid pressures, or tensile members formed from textiles or foam materials, for example, may be incorporated into chambers 40 and 50. Although the fluid pressures within chambers 40 and 50 may be different, chambers 40 and 50 may have substantially equal fluid pressures in some configurations of footwear 10.

Due to the relatively low pressure that may be utilized for chambers 40 and 50, the materials forming chambers 40 and 50 need not provide barrier characteristics that operate to retain the relatively high fluid pressures of some conventional chambers. A wide range of polymeric materials, including thermoplastic urethane, may be utilized to form chambers 40 and 50, and a variety of fluids (e.g., air or nitrogen) may be utilized within chambers 40 and 50. Furthermore, the polymeric material of chambers 40 and 50 may be selected based upon the engineering properties of the material (e.g., tensile strength, stretch properties, fatigue characteristics, dynamic modulus, and loss tangent), rather than the ability of the material to prevent the diffusion of the fluid contained by chambers 40 and 50. That is, a wider range of materials are suitable for chambers 40 and 50 due to the lower fluid pressures within chambers 40 and 50. When formed of thermoplastic urethane, the walls of chambers 40 and 50 may have a thickness of approximately 0.040 inches, but the thickness may range from 0.010 inches to 0.080 inches, for example.

In addition to thermoplastic urethane, a variety of other polymeric materials may be utilized for chambers 40 and 50. Examples of thermoplastic elastomer materials include polyurethane, polyester, polyester polyurethane, and polyether polyurethane. In addition, chambers 40 and 50 may be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for chambers 40 and 50 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al. In addition to air and nitrogen, the fluid contained by chambers 40 and 50 may be any of the gasses disclosed in U.S. Pat. No. 4,340,626 to Rudy, such as hexafluoroethane and sulfur hexafluoride, for example. In addition, the fluid may include octafluorapropane.

Each of chambers 40 and 50 may be manufactured through a variety of manufacturing techniques, including blowmolding, thermoforming, and rotational molding, for example. With regard to the blowmolding technique, thermoplastic material is placed in a mold having the general shape of chambers 40 and 50 and pressurized air is utilized to induce the material to coat surfaces of the mold. Given the configuration of chambers 40 and 50, wherein projections 43 and 53 effectively form lobes that extend outward from a central area of chambers 40 and 50, the general manufacturing process discussed in U.S. Pat. No. 7,000,335 to Swigart, et al., which is incorporated herein by reference, may be utilized to form one or both of chambers 40 and 50. In the thermoforming technique, layers of thermoplastic material are placed between corresponding portions of a mold, and the mold is utilized to compress the layers together at peripheral locations of chamber 40. A positive pressure may be applied between the layers of thermoplastic material to induce the layers into the contours of the mold. In addition, a vacuum may be induced in the area between the layers and the mold to draw the layers into the contours of the mold. In the rotational molding technique, thermoplastic material is placed in a mold that subsequently rotates to induce the thermoplastic material to coat or otherwise form a layer upon surfaces of the mold.

Pneumatic component 33 produces a relatively large deflection during initial stages of compression when compared to the fluid-filled chambers discussed in the Background of the Invention section. As the compression of chambers 40 and 50 increases, however, the stiffness of pneumatic component 33 increases in a corresponding manner due to the structure of chambers 40 and 50 and the manner in which chambers 40 and 50 are incorporated into sole structure 30. Three phenomena operate simultaneously to produce the effect described above and include pressure ramping, film tensioning, and the interlocking of chambers 40 and 50. Each of these phenomena will be described in greater detail below.

Pressure ramping is the increase in pressure within chambers 40 and 50 that occurs as a result of compressing pneumatic component 33. In effect, chambers 40 and 50 have an initial pressure and initial volume when not being compressed within sole structure 30. As pneumatic component 33 is compressed, however, the effective volume of chambers 40 and 50 decrease, thereby increasing the pressure of the fluid within chambers 40 and 50. The increase in pressure operates to provide a portion of the cushioning response of pneumatic component 33.

The concept of film tensioning also has an effect upon the cushioning response of pneumatic component 33. This effect is best understood when compared to pressurized prior art chambers. In the prior art chambers, the pressure within the chambers places the outer layers in tension. As the prior art chambers are compressed, however, the tension in the outer layers is relieved or lessened. Accordingly, compression of the prior art chambers operates to lessen the tension in the outer layers. In contrast with the pressurized prior art chambers, the tension in the polymer material forming chambers 40 and 50 increases in response to compression due to bending of the polymer material (e.g., in upper surface 41). This increase in tension contributes to the cushioning response of pneumatic component 33.

Finally, the interlocking of chambers 40 and 50 contributes to the cushioning response of pneumatic component 33. When pneumatic component 33 is compressed, the fluid pressures within chambers 40 and 50 increase proportionally. As the pressures increase, the tension in the polymer material forming chambers 40 and 50 also increases proportionally and portions of the polymer material stretch or otherwise expand. In areas where chambers 40 and 50 are in contact with each other (e.g., surfaces 42 and 52), the opposing forces counteract expansion. That is, lower surface 42 of chamber 40 presses against upper surface 52 of chamber 50, and upper surface 52 of chamber 50 presses against lower surface 42 of chamber 40. These opposing forces counteract, therefore, a tendency for portions of surfaces 42 and 52 to stretch or otherwise expand. Other areas of chambers 40 and 50 are placed in tension (see film tensioning discussion above) and contribute to the cushioning response of pneumatic component 33.

Based upon the considerations of pressure ramping, film tensioning, and the interlocking of chambers 40 and 50 discussed above, the cushioning response of pneumatic component 33 is modifiable to provide a desired degree of force attenuation in sole structure 30. For example, the volume of chambers 40 and 50, the number and shape of projections 43 and 53, the thickness of the polymer material forming chambers 40 and 50, the material utilized to form chambers 40 and 50, the relative surface areas of contact between chambers 40 and 50, and the position and orientation of chambers 40 and 50 within sole structure 30 may be varied to modify the cushioning response. By varying these and other parameters, therefore, sole structure 30 may be custom tailored to a specific individual or to provide a specific cushioning response during compression.

Another factor that may be utilized to affect the cushioning response of pneumatic component 33 relates to the relative volumes of chambers 40 and 50. In general, as the volume of chambers 40 and 50 increases, the compliance (i.e., compressibility) of chambers 40 and 50 increases. Similarly, as the volume of chambers 40 and 50 decreases, the compliance of chambers 40 and 50 decreases. In order to impart different degrees of compliance to different portions of sole structure 30, chambers 40 and 50 may be structured to have different volumes. For example, chamber 40 may have a volume that is relatively large in comparison with chamber 50, thereby imparting relatively large compliance. In addition, chamber 50 may have a volume that is relatively small in comparison with chamber 40, thereby imparting relatively small compliance. When chambers 40 and 50 have different volumes and are utilized in combination, the different degrees of compliance may provide different cushioning responses during walking (wherein forces upon sole structure 30 are relatively small) and running (wherein forces upon sole structure 30 are relatively large).

In addition to the relative volumes of chambers 40 and 50, the relative shapes and sizes of various portions of chambers 40 and 50 may also affect the cushioning response of pneumatic component 33. As an example, the sizes of projections 43 and 53 have an effect upon the cushioning response. As the sizes of projections 43 and 53 increase, the compliance of chambers 40 and 50 generally increase. Similarly, as the sizes of projections 43 and 53 decrease, the compliance of chambers 40 and 50 generally decreases. In configurations where greater stability is desired, projections 43 and 53 may be shaped to impart the stability. Accordingly, modifying the volume of chambers 40 and 50 and also modifying the shapes for various portion of chambers 40 and 50 may be utilized to modify the cushioning response of pneumatic component 33.

A majority of an exterior of pneumatic component 33 is formed from a single layer of polymer material because each of chambers 40 and 50 are formed from a single layer of polymer material. At the interface between chambers 40 and 50 (i.e., where surfaces 42 and 52 make contact), which is located in the interior of pneumatic component 33, two coextensive layers of the polymer material subdivide the fluid of first chamber 40 from the fluid of second chamber 50. Whereas the exterior of pneumatic component 33 is a single layer of the polymer material, the interior of pneumatic component 33 is two coextensive layers of the polymer material. In some configurations of pneumatic component 33, however, chambers 40 and 50 may be secured together such that only one layer of the polymer material subdivides the fluids within chambers 40 and 50.

Although first chamber 40 is generally positioned above second chamber 50 in footwear 10, both chambers 40 and 50 form upper and lower surfaces of pneumatic component 33. A majority of the upper surface of pneumatic component 33 is formed from upper surface 41 of first chamber 40. Distal ends of projections 53, however, also form a portion of the upper surface of pneumatic component 33. Similarly, a majority of the lower surface of pneumatic component 33 is formed is formed from lower surface 51 of second chamber 50. Distal ends of projections 43, however, also form a portion of the lower surface of pneumatic component 33. Accordingly, the upper and lower surfaces of pneumatic component 33 are cooperatively formed from each of chambers 40 and 50. In some configurations, however, the upper surface of pneumatic component 33 may be formed from only chamber 40 and the lower surface of pneumatic component 33 may be formed from only chamber 50.

Figure 9A:
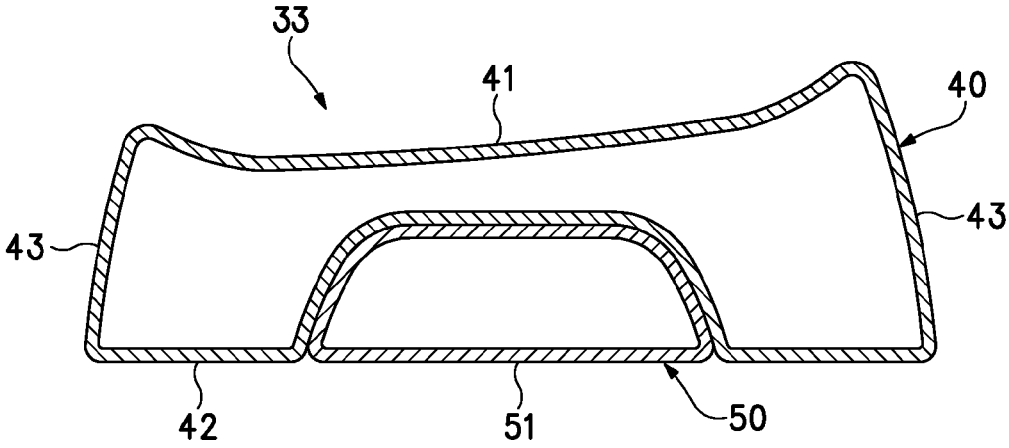
FIGS. 9A-9C are cross-sectional views corresponding with FIG. 4A and depicting alternate configurations of the first pneumatic component.
Figure 9B:
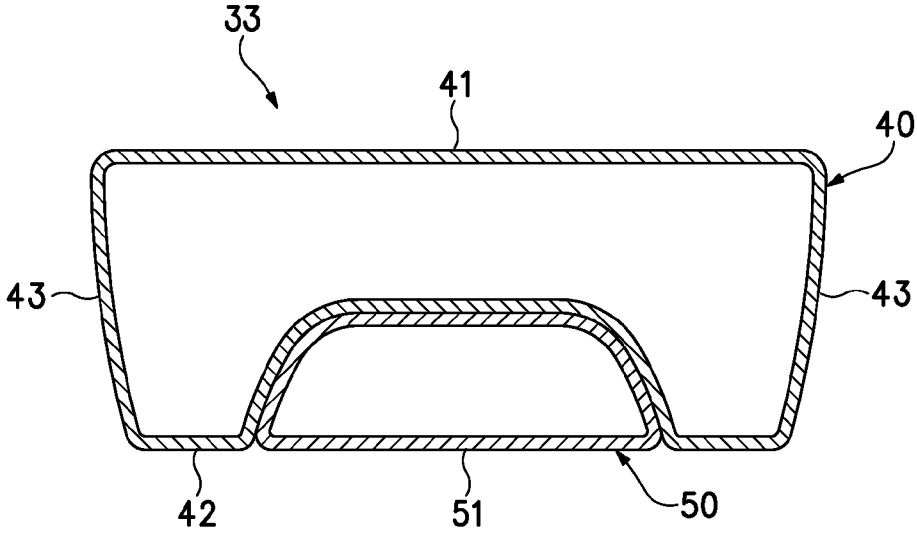
Figure 9C:
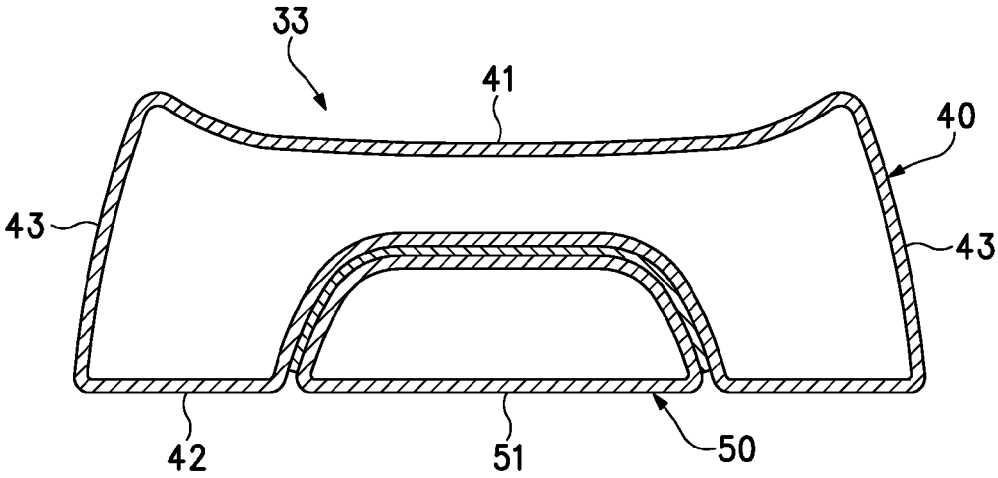

The configuration of pneumatic component 33 discussed above and depicted in the figures may vary significantly to impart different properties to footwear 10. As depicted in FIG. 9A, for example, one or both of chambers 40 and 50 may be tapered to control or otherwise minimize pronation (i.e., rolling of the foot from lateral side 14 to medial side 15). In order to provide positive placement of the foot with respect to pneumatic component 33, upper surface 41 of first chamber 40 is concave, as depicted in FIGS. 4A and 4B. That is, upper surface 41 may be concave in some configurations of pneumatic component 33 to provide an area that receives the foot. As an alternative, however, upper surface 41 may also be planar, as depicted in FIG. 9B. As another variation, a plate or other sole element may extend between chambers 40 and 50, as depicted in FIG. 9C. In areas where greater stability is desired, pneumatic component 33 may define apertures that are filled with foam or other materials that compress less than pneumatic component 33. For example, portions of pneumatic component 33 corresponding with medial side 15 may define apertures that receive foam to limit the degree of pronation in the foot.

The coloring of chambers 40 and 50 may be utilized to impart pneumatic component 33 with unique aesthetic properties. In some configurations, the polymer materials of chambers 40 and 50 may be both transparent and colored. If, for example, chamber 40 has a blue coloring and chamber 50 has a yellow coloring, the interface between chambers 40 and 50 may appear to have a green coloring. That is, each of projections 43 and 53 may have different colors, but the colors may appear to combine where projections 43 and 53 make contact with each other. Accordingly, the portions of first chamber 40 and second chamber 50 that are visible from the exterior of article of footwear 10 may have different colors, and the different colors may combine to produce a third color at the interface between chambers 40 and 50.

Second Component Configuration

Figure 10:
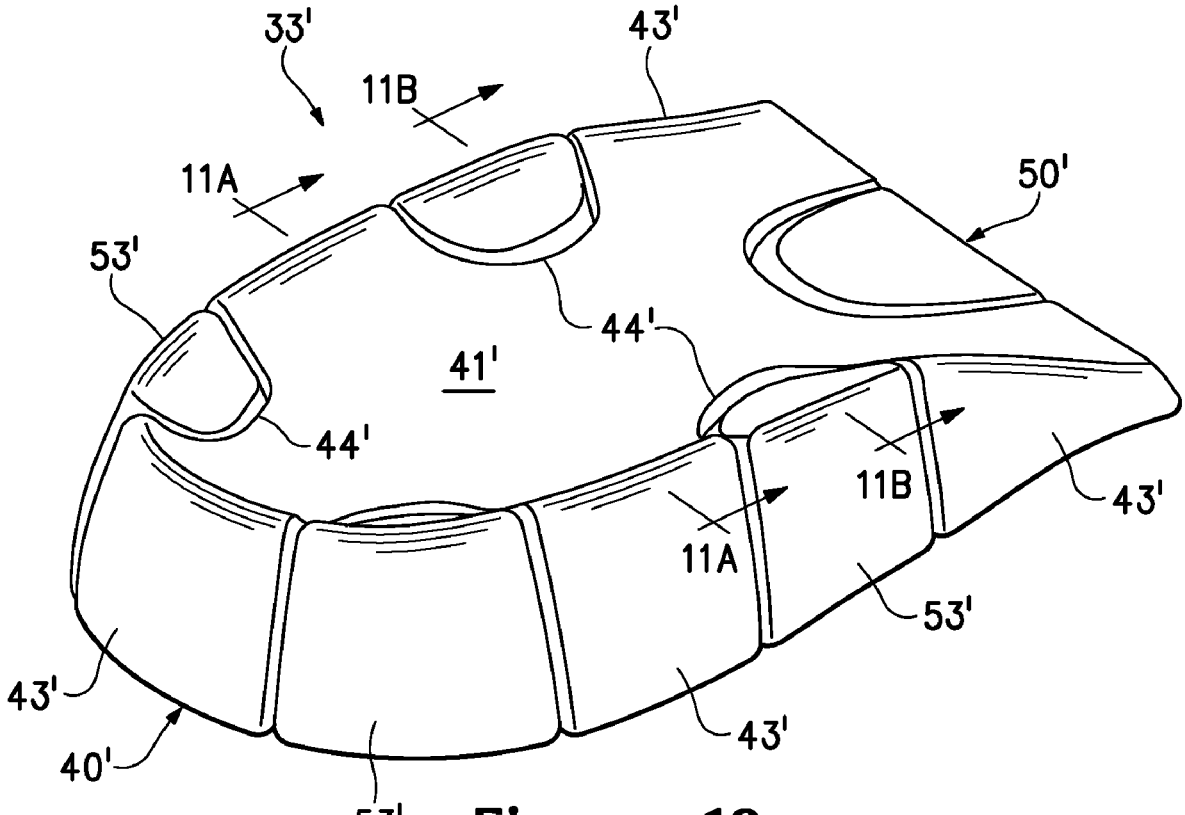
FIG. 10 is a perspective view of a second pneumatic component that may be utilized with the article of footwear.
Figure 11A:
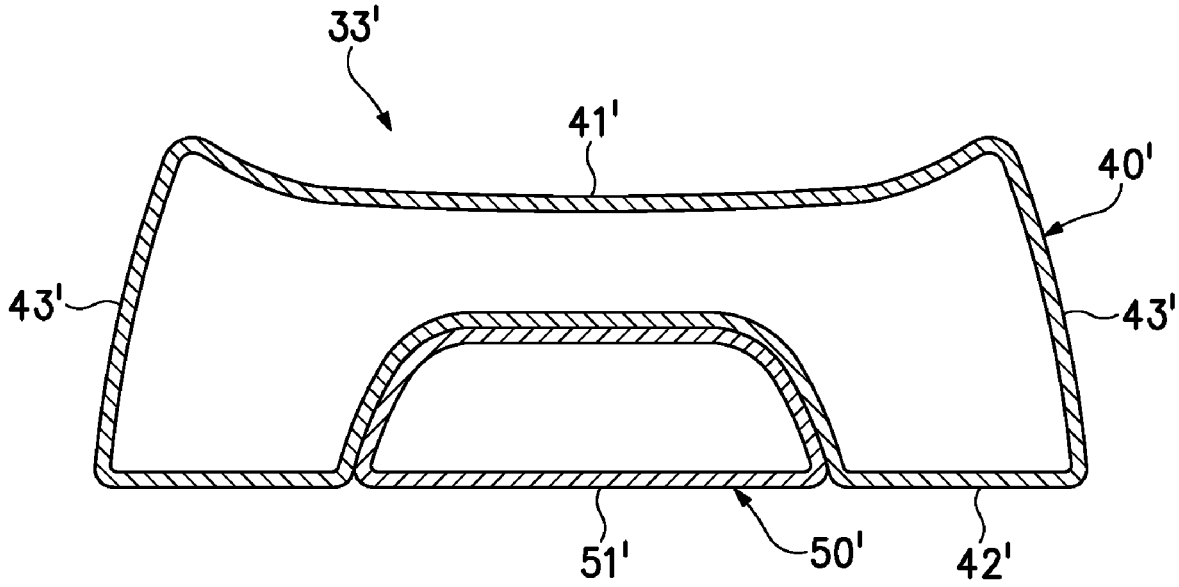
FIGS. 11A and 11B are a cross-sectional views of the second pneumatic component, as defined by section lines 11A and 11B in FIG. 10.
Figure 11B:
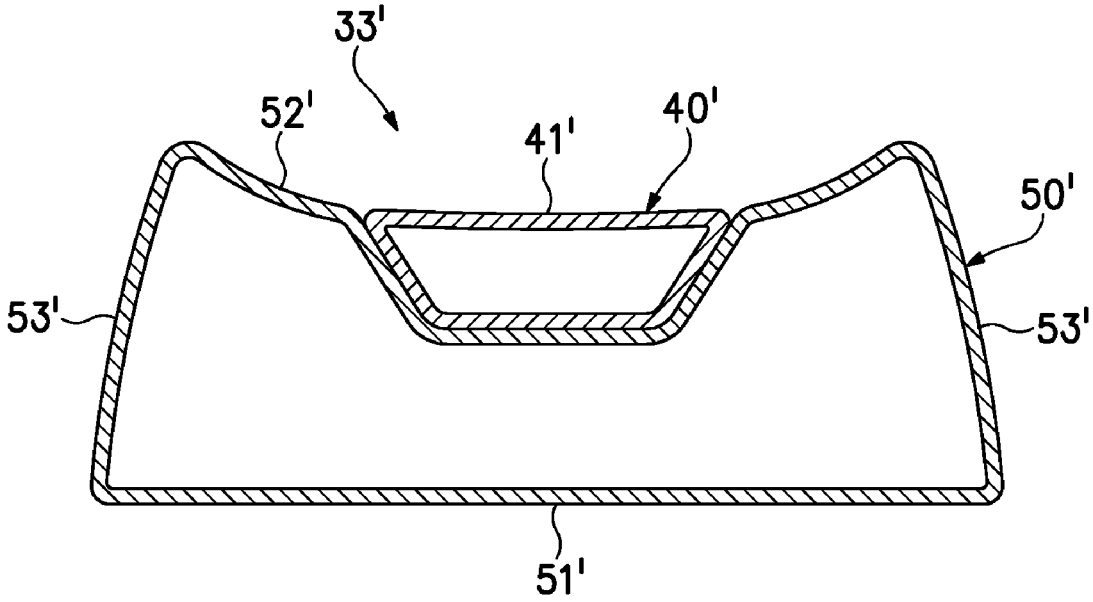

Another pneumatic component 33' that may be incorporated into footwear 10 is depicted in FIGS. 10-12. Whereas, pneumatic component 33 is primarily located in heel region 13, pneumatic component 33' has greater overall length and may extend through heel region 13 and into portions of midfoot region 12. The primary elements of pneumatic component 33' are a first chamber 40' and a second chamber 50'. Each of chambers 40' and 50' are formed from an exterior barrier that encloses a fluid. More particularly, chambers 40' and 50' are formed from a polymer material that is sealed to enclose a gas. As with chambers 40 and 50, portions of chambers 40' and 50' have corresponding configurations that interlock or otherwise mate to join chambers 40' and 50' to each other. Although the corresponding configurations of chambers 40' and 50' are sufficient to join chambers 40' and 50' to each other when incorporated into footwear 10, various adhesives, thermobonding processes, or other joining techniques may be utilized to further secure chamber 40' to chamber 50'. Alternately, the polymer foam material of midsole element 31 may encapsulate portions of chambers 40' and 50' to effectively secure chamber 40' to chamber 50'.

Figure 13:
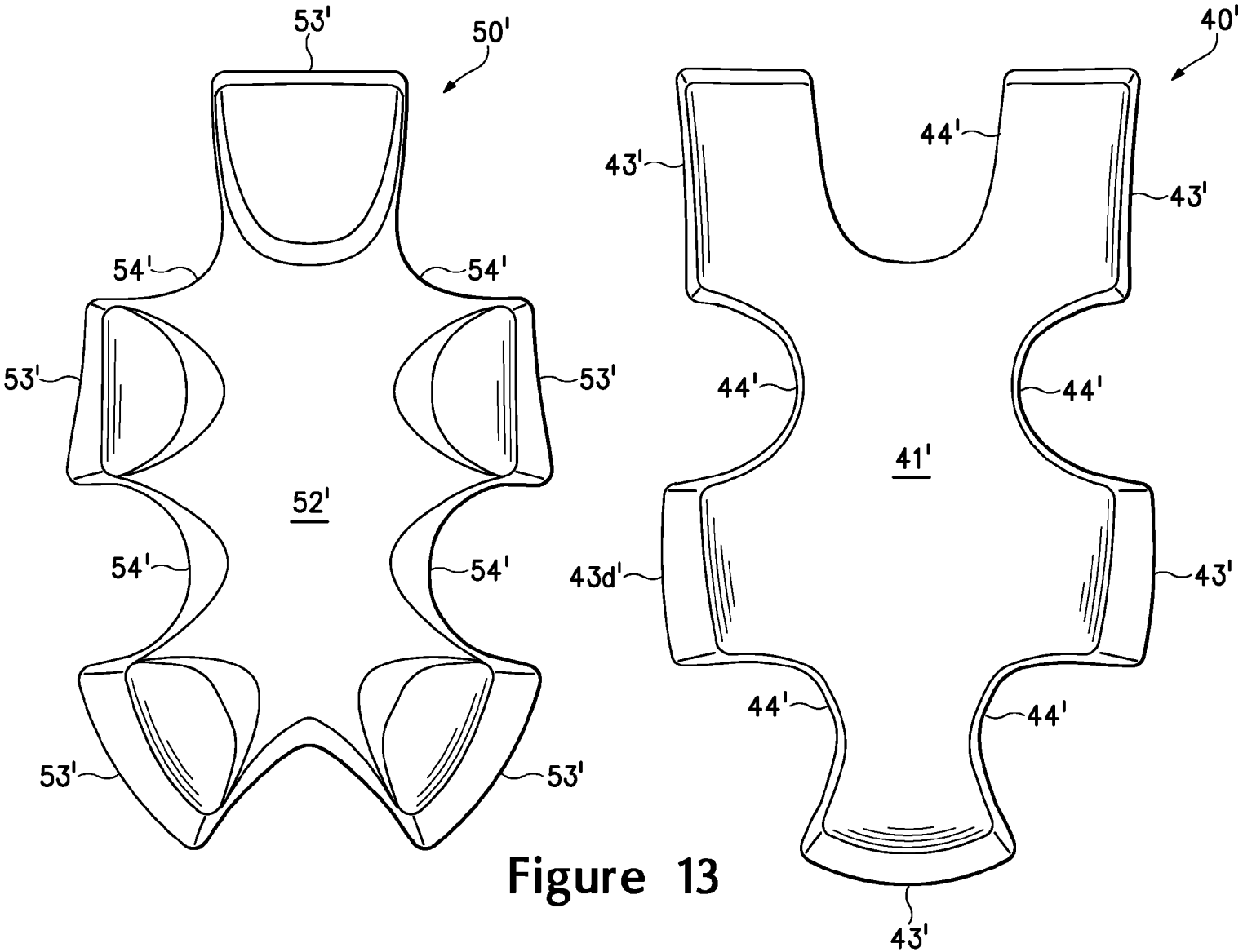
FIG. 13 depicts top plan views of a first chamber and a second chamber of the second pneumatic component.
Figure 14:
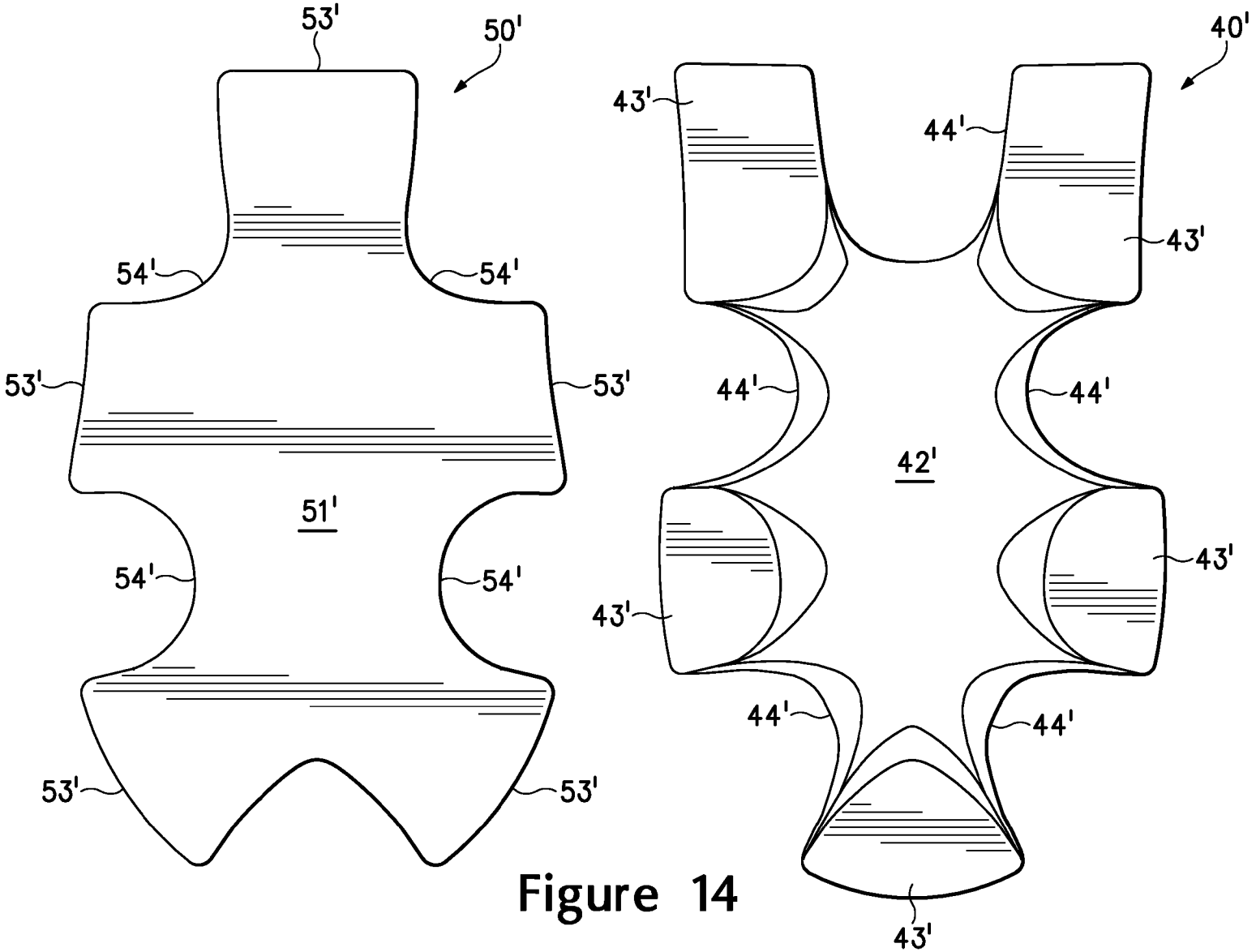
FIG. 14 depicts bottom plan views of the first chamber and the second chamber of the second pneumatic component.
Figure 15:
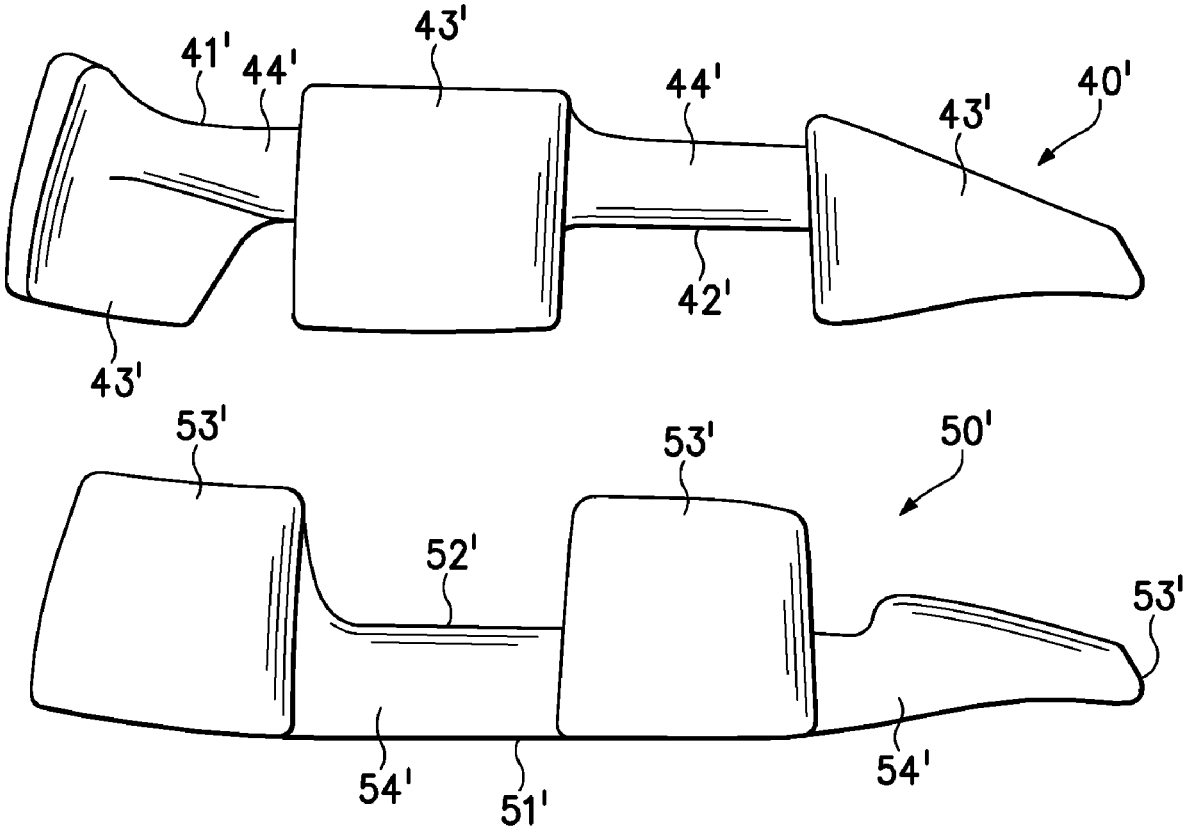
FIG. 15 depicts side elevational views of the first chamber and the second chamber of the second pneumatic component.

First chamber 40' is depicted in FIGS. 13-15 and has an upper surface 41' and an opposite lower surface 42'. Although upper surface 41' exhibits a somewhat concave configuration, lower surface 42' is significantly contoured to define five projections 43' and five depressions 44' located between projections 43'. Relative to upper surface 41', projections 43' extend (a) radially-outward from a central area of first chamber 40' and in a direction that is generally parallel to upper surface 41' and (b) downward and away from upper surface 41'. That is, projections 43' extend both radially-outward and downward to impart a three-dimensional structure to first chamber 40'. In effect, therefore, projections 43' form lobes that extend from the central area, and depressions 44' are spaces located between the lobes.

Second chamber 50' is also depicted in FIGS. 13-15 and has a lower surface 51' and an opposite upper surface 52'. Whereas lower surface 51 exhibits a generally planar configuration, upper surface 52' is contoured to define five projections 53' and five depressions 54' located between projections 53'. Relative to the plane defined by lower surface 51', projections 53' extend (a) radially-outward from a central area of second chamber 50' and in a direction that is parallel to the plane defined by lower surface 51' and (b) upward and away from the plane defined by lower surface 51'. That is, projections 53' extend both radially-outward and upward to impart a three-dimensional structure to second chamber 50'. In effect, therefore, projections 53' form lobes that extend from the central area, and depressions 54' are spaces located between the lobes.

Each of chambers 40' and 50' may be oriented differently when incorporated into footwear 10. Whereas projections 43' of first chamber 40' extend downward, projections 53' of second chamber 50' extend upward. In this configuration, and as generally depicted in FIGS. 10 and 12, projections 43' respectively extend into depressions 54', and projections 53' respectively extend into depressions 44'. Lower surface 42' and upper surface 52' form, therefore, oppositely-contoured surfaces that interlock or otherwise mate to join chambers 40' and 50' to each other.

Chambers 40' and 50' may be pressurized in the manner discussed above for chambers 40 and 50. The fluids within chambers 40' and 50', the polymeric materials forming chambers 40' and 50', and the thicknesses of the polymeric materials, may also be the same as the fluids, materials, and thicknesses discussed above for chambers 40 and 50. In addition, the variety of manufacturing techniques discussed above for chambers 40 and 50 may also be utilized for chambers 40' and 50'. With the exception of the structural differences discussed above, therefore, chambers 40' and 50' may be substantially similar to chambers 40 and 50. Furthermore, the concepts of pressure ramping, film tensioning, the interlocking of chambers 40' and 50', and relative volumes of chambers 40' and 50' may operate simultaneously to affect the cushioning response of pneumatic component 33'.

A majority of an exterior of pneumatic component 33' is formed from a single layer of polymer material because each of chambers 40' and 50' are formed from a single layer of polymer material. At the interface between chambers 40' and 50' (i.e., where surfaces 42' and 52' make contact), which is located in the interior of pneumatic component 33', two coextensive layers of the polymer material subdivide the fluid of first chamber 40' from the fluid of second chamber 50'. Whereas the exterior of pneumatic component 33' is a single layer of the polymer material, therefore, the interior of pneumatic component 33' is two coextensive layers of the polymer material. In some configurations of pneumatic component 33', however, chambers 40' and 50' may be secured together such that only one layer of the polymer material subdivides the fluids within chambers 40' and 50'.

Although first chamber 40' is generally positioned above second chamber 50' in footwear 10', both chambers 40' and 50' form upper and lower surfaces of pneumatic component 33'. A majority of the upper surface of pneumatic component 33' is formed is formed from upper surface 41' of first chamber 40'. Distal ends of projections 53', however, also form a portion of the upper surface of pneumatic component 33'. Similarly, a majority of the lower surface of pneumatic component 33' is formed from lower surface 51' of second chamber 50'. Distal ends of projections 43', however, also form a portion of the lower surface of pneumatic component 33'. Accordingly, the upper and lower surfaces of pneumatic component 33' are cooperatively formed from each of chambers 40' and 50'. In some configurations, however, the upper surface of pneumatic component 33' may be formed from only chamber 40' and the lower surface of pneumatic component 33' may be formed from only chamber 50'.

The coloring of chambers 40' and 50' may be utilized to impart pneumatic component 33' with unique aesthetic properties. In some configurations, the polymer materials of chambers 40' and 50' may be both transparent and colored. If, for example, chamber 40' has a blue coloring and chamber 50' has a yellow coloring, the interface between chambers 40' and 50' may appear to have a green coloring. That is, each of projections 43' and 53' may have different colors, but the colors may appear to combine where projections 43' and 53' make contact with each other. Accordingly, the portions of first chamber 40' and second chamber 50' that are visible from the exterior of article of footwear 10 may have different colors, and the different colors may combine to produce a third color at the interface between chambers 40' and 50'.

Third Component Configuration

Figure 16:
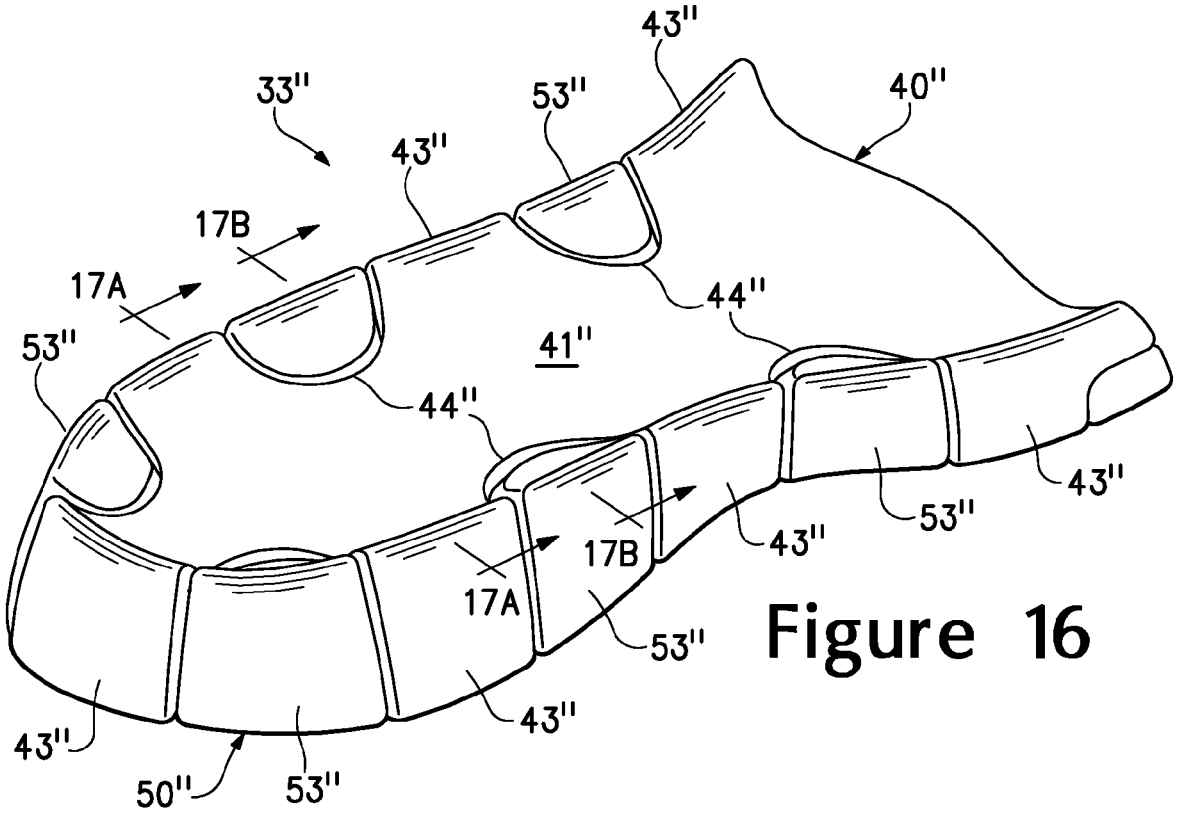
FIG. 16 is a perspective view of a third pneumatic component that may be utilized with the article of footwear.
Figure 17A:
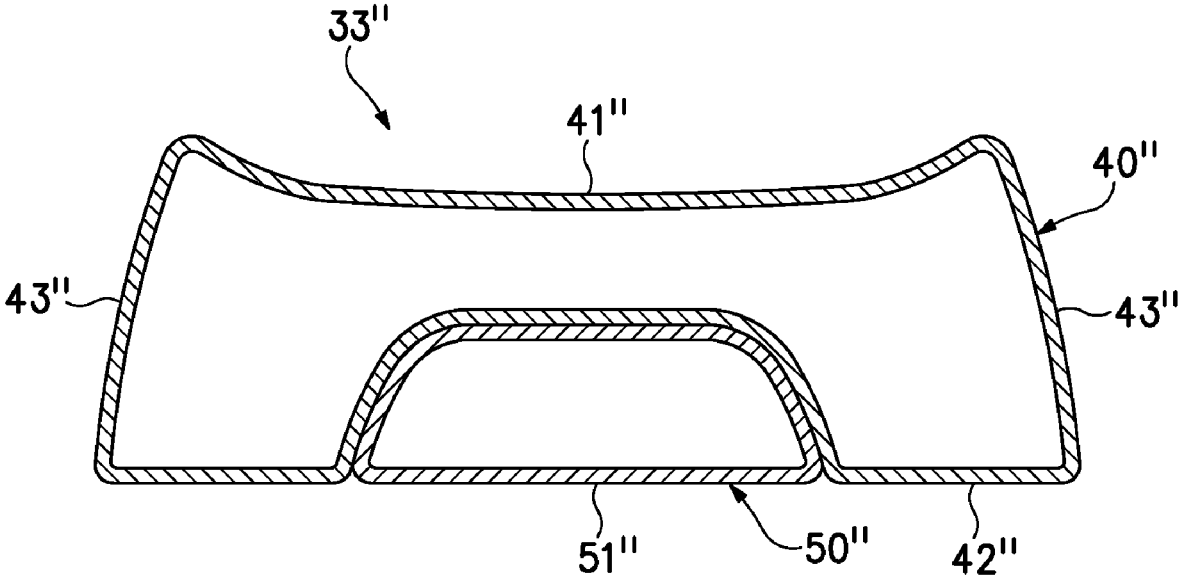
FIGS. 17A and 17B are a cross-sectional views of the third pneumatic component, as defined by section lines 17A and 17B in FIG. 16.
Figure 17B:
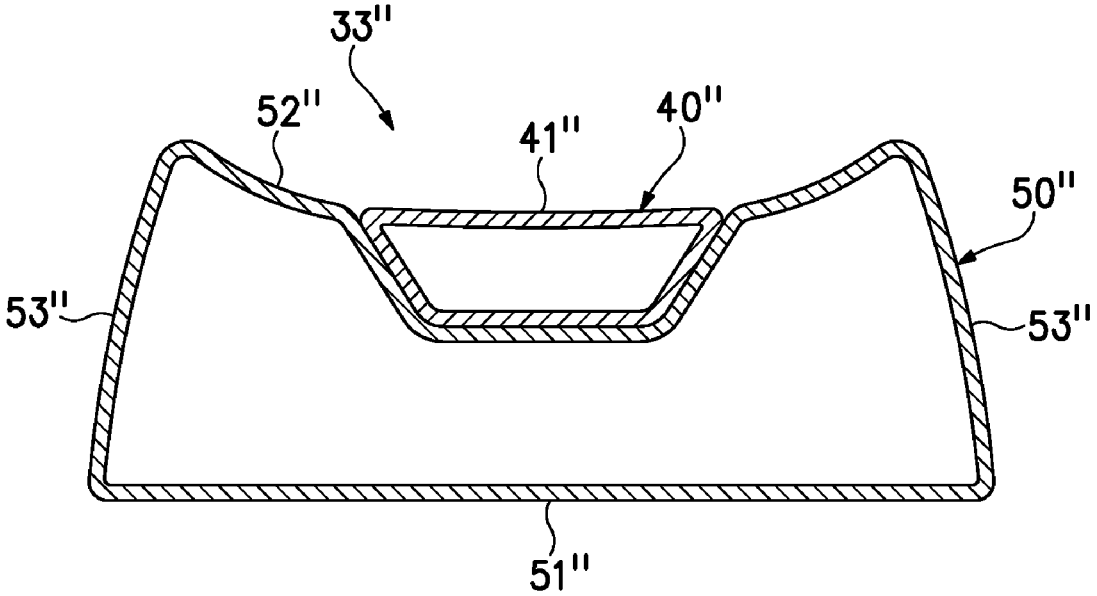
Figure 18:
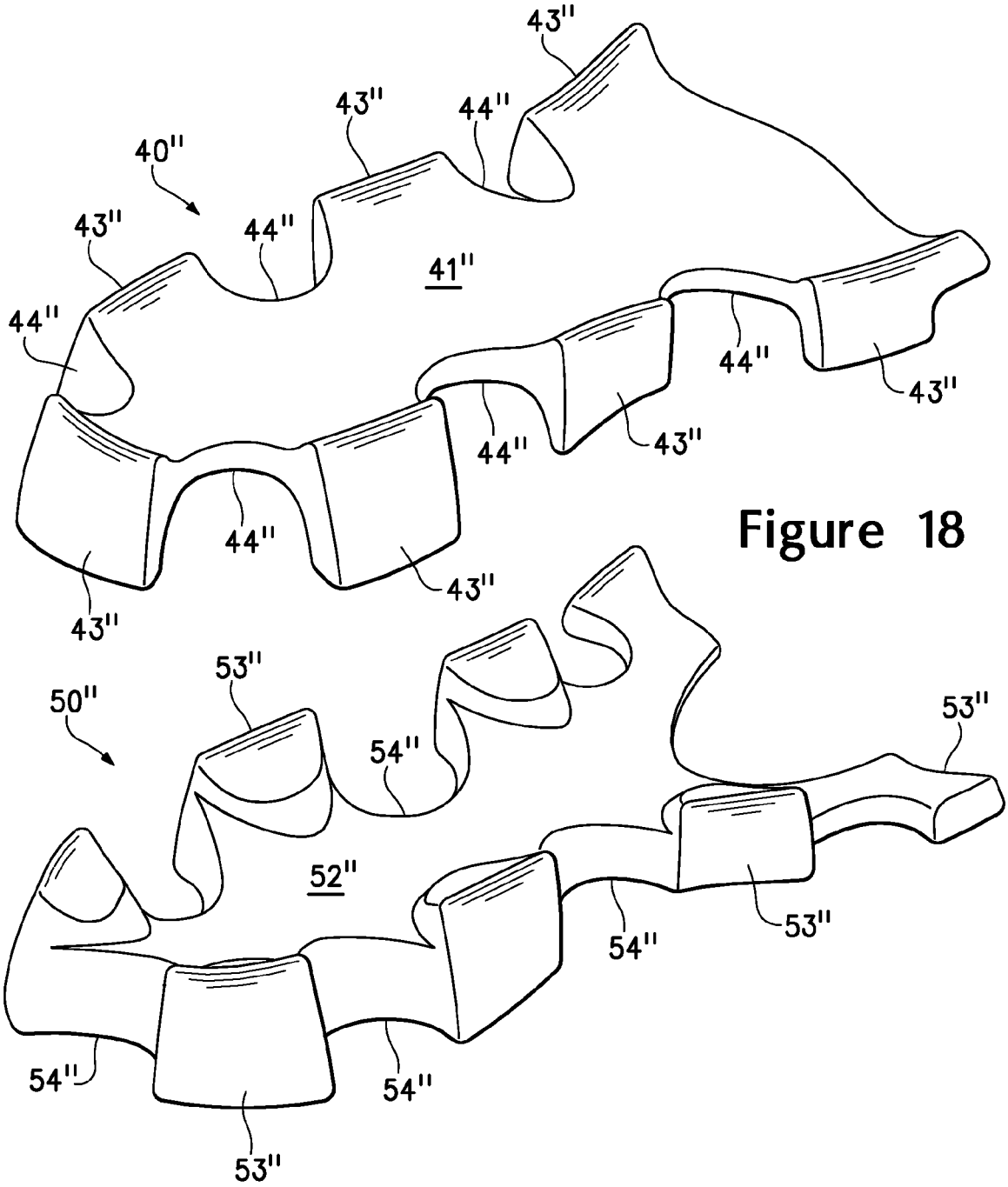
FIG. 18 is an exploded perspective view of the third pneumatic component.

Another pneumatic component 33" that may be incorporated into footwear 10 is depicted in FIGS. 16-18. Whereas, pneumatic component 33 is primarily located in heel region 13, pneumatic component 33" has greater overall length and may extend through heel region 13 and into portions of midfoot region 12 and forefoot region 11. The primary elements of pneumatic component 33" are a first chamber 40" and a second chamber 50". Each of chambers 40" and 50" are formed from an exterior barrier that encloses a fluid. More particularly, chambers 40" and 50" are formed from a polymer material that is sealed to enclose a gas. As with chambers 40 and 50, portions of chambers 40" and 50" have corresponding configurations that interlock or otherwise mate to join chambers 40" and 50" to each other. Although the corresponding configurations of chambers 40" and 50" are sufficient to join chambers 40" and 50" to each other when incorporated into footwear 10, various adhesives, thermobonding processes, or other joining techniques may be utilized to further secure chamber 40" to chamber 50". Alternately, the polymer foam material of midsole element 31 may encapsulate portions of chambers 40" and 50" to effectively secure chamber 40" to chamber 50".

Figure 19:
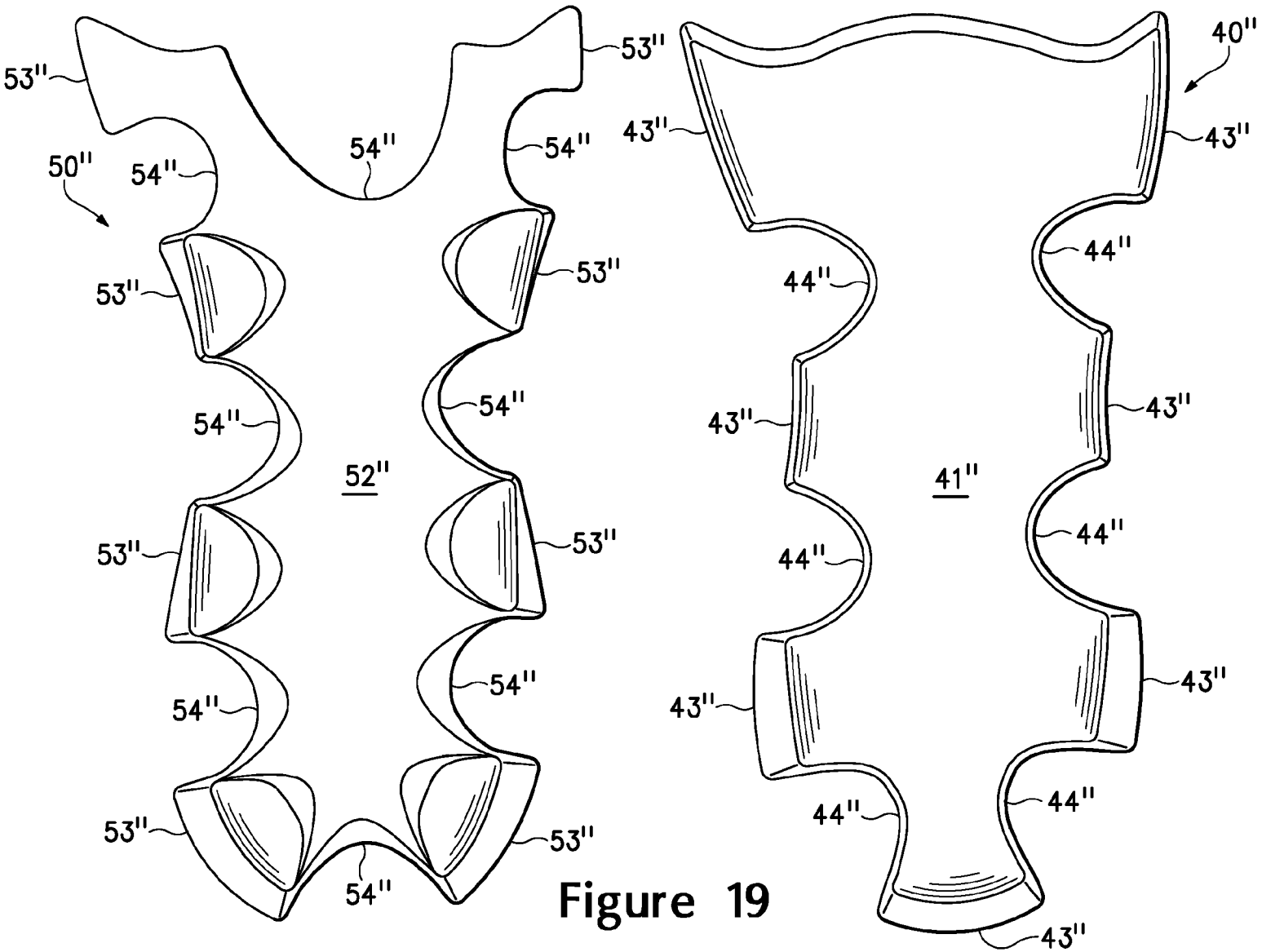
FIG. 19 depicts top plan views of a first chamber and a second chamber of the third pneumatic component.
Figure 20:
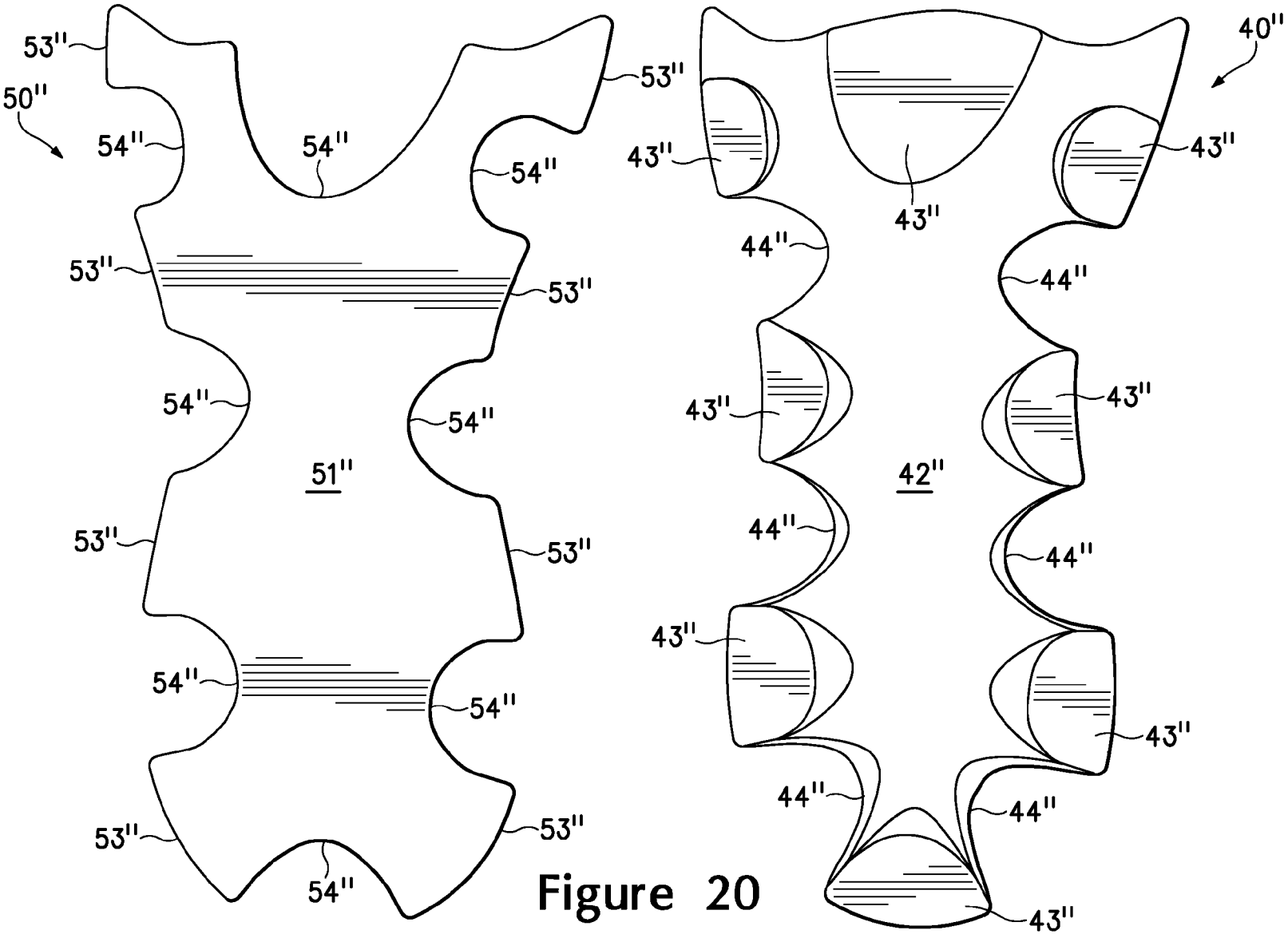
FIG. 20 depicts bottom plan views of the first chamber and the second chamber of the third pneumatic component.
Figure 21:
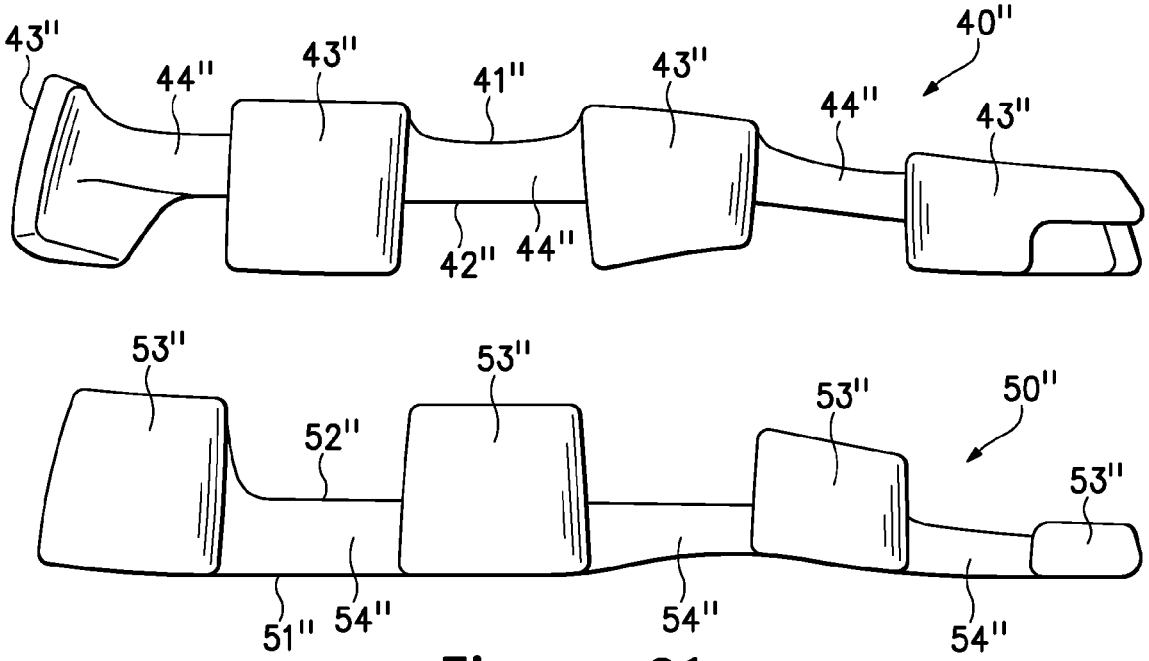
FIG. 21 depicts side elevational views of the first chamber and the second chamber of the third pneumatic component.

First chamber 40" is depicted in FIGS. 19-21 and has an upper surface 41" and an opposite lower surface 42". Although upper surface 41" exhibits a somewhat concave configuration, lower surface 42" is significantly contoured to define eight projections 43" and eight depressions 44" located between projections 43". Relative to upper surface 41", projections 43" extend (a) radially-outward from a central area of first chamber 40" and in a direction that is generally parallel to upper surface 41" and (b) downward and away from upper surface 41". That is, projections 43" extend both radially-outward and downward to impart a three-dimensional structure to first chamber 40". In effect, therefore, projections 43" form lobes that extend from the central area, and depressions 44" are spaces located between the lobes.

Second chamber 50" is also depicted in FIGS. 19-21 and has a lower surface 51" and an opposite upper surface 52". Whereas lower surface 51 exhibits a generally planar configuration, upper surface 52" is contoured to define eight projections 53" and eight depressions 54" located between projections 53". Relative to the plane defined by lower surface 51", projections 53" extend (a) radially-outward from a central area of second chamber 50" and in a direction that is parallel to the plane defined by lower surface 51" and (b) upward and away from the plane defined by lower surface 51". That is, projections 53" extend both radially-outward and upward to impart a three-dimensional structure to second chamber 50". In effect, therefore, projections 53" form lobes that extend from the central area, and depressions 54" are spaces located between the lobes.

Each of chambers 40" and 50" may be oriented differently when incorporated into footwear 10. Whereas projections 43" of first chamber 40" extend downward, projections 53" of second chamber 50" extend upward. In this configuration, and as generally depicted in FIGS. 16 and 18, projections 43" respectively extend into depressions 54", and projections 53" respectively extend into depressions 44". Lower surface 42" and upper surface 52" form, therefore, oppositely-contoured surfaces that interlock or otherwise mate to join chambers 40" and 50" to each other.

Chambers 40" and 50" may be pressurized in the manner discussed above for chambers 40 and 50. The fluids within chambers 40" and 50", the polymeric materials forming chambers 40" and 50", and the thicknesses of the polymeric materials, may also be the same as the fluids, materials, and thicknesses discussed above for chambers 40 and 50. In addition, the variety of manufacturing techniques discussed above for chambers 40 and 50 may also be utilized for chambers 40" and 50". With the exception of the structural differences discussed above, therefore, chambers 40" and 50" may be substantially similar to chambers 40 and 50. Furthermore, the concepts of pressure ramping, film tensioning, the interlocking of chambers 40" and 50", and relative volumes of chambers 40" and 50" may operate simultaneously to affect the cushioning response of pneumatic component 33".

A majority of an exterior of pneumatic component 33" is formed from a single layer of polymer material because each of chambers 40" and 50" are formed from a single layer of polymer material. At the interface between chambers 40" and 50" (i.e., where surfaces 42" and 52" make contact), which is located in the interior of pneumatic component 33", two coextensive layers of the polymer material subdivide the fluid of first chamber 40" from the fluid of second chamber 50". Whereas the exterior of pneumatic component 33" is a single layer of the polymer material, therefore, the interior of pneumatic component 33" is two coextensive layers of the polymer material. In some configurations of pneumatic component 33", however, chambers 40" and 50" may be secured together such that only one layer of the polymer material subdivides the fluids within chambers 40" and 50".

Although first chamber 40" is generally positioned above second chamber 50" in footwear 10", both chambers 40" and 50" form upper and lower surfaces of pneumatic component 33". A majority of the upper surface of pneumatic component 33" is formed is formed from upper surface 41" of first chamber 40". Distal ends of projections 53", however, also form a portion of the upper surface of pneumatic component 33". Similarly, a majority of the lower surface of pneumatic component 33" is formed from lower surface 51" of second chamber 50". Distal ends of projections 43", however, also form a portion of the lower surface of pneumatic component 33". Accordingly, the upper and lower surfaces of pneumatic component 33" are cooperatively formed from each of chambers 40" and 50". In some configurations, however, the upper surface of pneumatic component 33" may be formed from only chamber 40" and the lower surface of pneumatic component 33" may be formed from only chamber 50".

The coloring of chambers 40" and 50" may be utilized to impart pneumatic component 33" with unique aesthetic properties. In some configurations, the polymer materials of chambers 40" and 50" may be both transparent and colored. If, for example, chamber 40" has a blue coloring and chamber 50" has a yellow coloring, the interface between chambers 40" and 50" may appear to have a green coloring. That is, each of projections 43" and 53" may have different colors, but the colors may appear to combine where projections 43" and 53" make contact with each other. Accordingly, the portions of first chamber 40" and second chamber 50" that are visible from the exterior of article of footwear 10 may have different colors, and the different colors may combine to produce a third color at the interface between chambers 40" and 50".

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of footwear having an upper and a sole structure secured to the upper, the sole structure comprising:

a first chamber that encloses a fluid and defines a plurality of first projections, the first chamber being exposed to form at least a portion of a lateral side and an opposite medial side of the sole structure; and a second chamber that encloses a fluid and is positioned adjacent the first chamber, the second chamber defining a plurality of second depressions, and the second chamber being exposed to form at least a portion of the lateral side and the medial side of the sole structure, the first chamber interlocking with the second chamber such that at least a portion of the first projections extend into the second depressions.

2. The article of footwear recited in claim 1, wherein the first projections are located at a periphery of the first chamber, and the second depressions are located at a periphery of the second chamber.

3. The article of footwear recited in claim 1, wherein the first chamber defines a plurality of first depressions and the second chamber defines a plurality of second projections, at least a portion of the second projections extending into the first depressions.

4. The article of footwear recited in claim 3, wherein the first projections and the first depressions are located at a periphery of the first chamber, and the second projections and the second depressions are located at a periphery of the second chamber.

5. The article of footwear recited in claim 3, wherein the first depressions are located between the first projections, and the second depressions are located between the second projections.

6. The article of footwear recited in claim 1, wherein the first chamber is in contact with the second chamber.

7. The article of footwear recited in claim 1, wherein an upper surface of the first chamber is positioned adjacent the upper and has a concave configuration.

8. The article of footwear recited in claim 1, wherein the first chamber and the second chamber are located in at least a heel region of the footwear.

9. The article of footwear recited in claim 1, wherein the fluid of at least one of the first chamber and the second chamber has a pressure within a range of zero and thirty-five kilopascals.

10. The article of footwear recited in claim 1, wherein an upper surface of the first chamber is secured to the upper, and a lower surface of the second chamber is secured to an outsole.

11. An article of footwear having an upper and a sole structure secured to the upper, the sole structure comprising:

a first chamber that encloses a fluid and is positioned adjacent the upper, the first chamber including a periphery that defines a plurality of first projections and a plurality of first depressions located between the first projections, the first projections extending toward a ground-engaging surface of the sole structure; and a second chamber that encloses a fluid and is positioned adjacent the first chamber, the second chamber including a periphery that defines a plurality of second projections and a plurality of second depressions located between the second projections, the second projections extending toward the upper, at least a portion of the first projections being located within the second depressions, and at least a portion of the second projections being located within the first depressions.

12. The article of footwear recited in claim 11, wherein the first projections form at least a portion of a sidewall of the first chamber, and the second projections form at least a portion of a sidewall of the second chamber.

13. The article of footwear recited in claim 12, wherein the sidewall of the first chamber and the sidewall of the second chamber are exposed to form a portion of an exterior surface of the sole structure.

14. The article of footwear recited in claim 11, wherein each of the first chamber and the second chamber are formed from a single layer of polymer material, and two layers of the polymer material extend between the fluid of the first chamber and the fluid of the second chamber.

15. The article of footwear recited in claim 11, wherein the first chamber is in contact with the second chamber.

16. The article of footwear recited in claim 11, wherein an upper surface of the first chamber has a concave configuration.

17. The article of footwear recited in claim 11, wherein the first chamber and the second chamber are located in at least a heel region of the footwear.

18. The article of footwear recited in claim 11, wherein the fluid of at least one of the first chamber and the second chamber has a pressure within a range of zero and thirty-five kilopascals.

19. The article of footwear recited in claim 11, wherein a pressure of the fluid within the first chamber is substantially equal to a pressure of the fluid within the second chamber.

20. The article of footwear recited in claim 11, wherein an upper surface of the first chamber is secured to the upper, and a lower surface of the second chamber is secured to an outsole.

21. An article of footwear having an upper and a sole structure secured to the upper, the sole structure comprising:

a first chamber that encloses a fluid, the first chamber having a first surface with a first contoured configuration that defines a plurality of downwardly-extending first projections; and a second chamber that encloses a fluid, the second chamber having a second surface with a second contoured configuration that defines a plurality of upwardly-extending second projections, the first surface being in contact with the second surface, and the first contoured configuration being shaped to mate with the second contoured configuration such that the first projections are positioned between the second projections.

22. The article of footwear recited in claim 21, wherein the first projections form at least a portion of a sidewall of the first chamber, and the second projections form at least a portion of a sidewall of the second chamber, the sidewall of the first chamber and the sidewall of the second chamber being exposed to form a portion of an exterior surface of the sole structure.

23. The article of footwear recited in claim 21, wherein the fluid of at least one of the first chamber and the second chamber has a pressure within a range of zero and thirty-five kilopascals.

24. The article of footwear recited in claim 21, wherein a pressure of the fluid within the first chamber is substantially equal to a pressure of the fluid within the second chamber.

* * * * *